US006287739B1

(12) United States Patent
Kawakami et al.

(10) Patent No.: US 6,287,739 B1
(45) Date of Patent: Sep. 11, 2001

(54) TONER, IMAGE FORMING METHOD, AND APPARATUS UNIT

(75) Inventors: Hiroaki Kawakami, Yokohama; Tatsuhiko Chiba, Kamakura; Michihisa Magome, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/347,261

(22) Filed: Jul. 6, 1999

(30) Foreign Application Priority Data

Jul. 6, 1998 (JP) ..... 10-190835

(51) Int. Cl.[7] ..... G03G 9/113
(52) U.S. Cl. ..... 430/108.7; 430/111; 399/222
(58) Field of Search ..... 430/106, 110, 430/111, 120, 108.7; 399/222

(56) References Cited

U.S. PATENT DOCUMENTS

| | | | | |
|---|---|---|---|---|
| 5,827,632 | | 10/1998 | Inaba et al. | 431/110 |
| 5,914,210 | * | 6/1999 | Demizu et al. | 430/110 |
| 5,981,129 | * | 11/1999 | Akazawa et al. | 430/110 |
| 5,981,132 | * | 11/1999 | Kurose et al. | 430/110 |
| 5,989,768 | * | 11/1999 | Little | 430/110 |

FOREIGN PATENT DOCUMENTS

| | | |
|---|---|---|
| 0564002 | 10/1993 | (EP) . |
| 0204751 | 7/1992 | (JP) . |
| 346682 | 12/1993 | (JP) . |
| 313980 | 11/1994 | (JP) . |
| 332235 | 12/1994 | (JP) . |
| 092724 | 4/1995 | (JP) . |
| 104501 | 4/1995 | (JP) . |
| 136439 | 5/1996 | (JP) . |

OTHER PUBLICATIONS

Catalog of FPIA–1000 published by Toa Tyou denshi K.K., 1995 Jun. edition.

Database WPJ, Section Ch, Week 9406, Derwent, XP002120322 (1994).

Database WPI, Section Ch Week 9219, Derwent, XP002120333 (1992).

Patent Abstract of Japan, vol. 14, No. 332 (P–1077) Jul. 1990.

* cited by examiner

*Primary Examiner*—John Goodrow
(74) *Attorney, Agent, or Firm*—Fitzpatrick, Cella, Harper & Scinto

(57) ABSTRACT

A toner has toner particles and an external additive. The toner particles have a weight-average particle diameter of from 4 $\mu$m to 9 $\mu$m. The external additive has (i) first, small-particle-diameter hydrophobic fine silica particles (A) having a BET specific surface area of from 100 $m^2/g$ to 350 $m^2/g$, having been treated with a silane, (ii) second, large-particle-diameter hydrophobic fine silica particles (B) having a BET specific surface area of from 15 $m^2/g$ to 80 $m^2/g$, having been treated with a silicone oil, and (iii) fine alumina particles (C) having a BET specific surface area of from 50 $m^2/g$ to 150 $m^2/g$.

176 Claims, 4 Drawing Sheets

TONER, IMAGE FORMING METHOD, AND APPARATUS UNIT

BACKGROUND OF THE INVENTION

1. Field of the Invention

This invention relates to a toner used in recording processes that utilize electrophotography, electrostatic recording or toner-jet recording. More particularly, this invention relates to a toner for developing electrostatic images, an image forming method making use of the toner, and an apparatus unit, used in copying machines, printers and facsimile machines in which a toner image is previously formed on an electrostatic latent image bearing member and thereafter transferred to a transfer medium to form an image.

2. Related Background Art

In toners used in electrophotography, electrostatic recording and toner-jet recording, it is commonly known to add small-particle-diameter inorganic fine particles to colored particles (toner particles) for the purpose of controlling the chargeability, fluidity and so forth of toner to attain good developing performance, cleaning performance and transfer performance.

However, toners to which such small-particle-diameter inorganic fine particles are added have been confirmed that toners having been used for a long time come into a state that the small-particle-diameter inorganic fine particles are buried in toner particle surfaces because of, e.g., the stress exerted thereon by carrier particles when used as two-component developers, the stress applied thereto from developer coating blade and developer feed roller when used as one-component developers, and the impact of toner particles against developing assembly inner walls and agitation blades and between toner particles.

In order to make such small-particle-diameter inorganic fine particles less buried in toner particles, it is effective to use large-particle-diameter inorganic fine particles in combination, as disclosed in Japanese Patent Application Laid-open No. 4-204751, No. 5-346682, No. 6-313980, No. 6-332235 and No. 7-92724.

The addition of large-particle-diameter inorganic fine particles brings about what is called the spacer effect, where the toner particle surfaces to which the small-particle-diameter inorganic fine particles having adhered can be prevented from coming into direct contact with the carrier, developer coating blade, developer feed roller, developing assembly inner walls and other toner particles to lessen the stress. This makes the small-particle-diameter inorganic fine particles less buried and enables achievement of a longer lifetime of the toner.

In order to make this spacer effect last, it is preferable to use silica as the large-particle-diameter inorganic fine particles. The reason therefor is as follows: The large-particle-diameter inorganic fine particles have a weaker electrostatic attraction to toner particle surfaces than the small-particle-diameter inorganic fine particles. Hence, the large-particle-diameter inorganic fine particles tend to become released from the toner particle surfaces to become smaller in quantity as a result of consumption during development, so that the spacer effect tends not to last. Here, the silica, which has a large charge quantity among inorganic fine particles and also is greatly attractable to toner particle surfaces, may become less released therefrom and can make the spacer effect last.

However, such toners to which the small-particle-diameter inorganic fine particles and large-particle-diameter silica have externally been added may come to have a too high chargeability in an environment of low humidity, i.e., tend to cause what is called the charge-up, showing an inferior environmental stability in some respect.

Meanwhile, as disclosed in Japanese Patent Application Laid-open No. 7-104501, a toner is proposed in which hydrophobic silica of 15 to 20 nm particle diameter, hydrophobic silica of 13 nm or smaller particle diameter and alumina are used as external additives. This toner can attain superior environmental properties in the two-component developers, which make use of carriers. However, in non-magnetic one-component developers, the hydrophobic silica of 15 to 20 nm may become released from toner particle surfaces to attain no sufficient performance with regard to the spacer effect, and the silica particles may acceleratedly become buried in toner particle surfaces, causing an increase in fog, faulty cleaning and a lowering of transfer efficiency. With regard to environmental properties, too, no sufficient performance can be obtained to cause a decrease in image density due to the charge-up and cause uneven images. This is considered due to the fact that the mechanical stress from the charging member blade is greater in non-magnetic one-component developers than in two-component developers.

SUMMARY OF THE INVENTION

An object of the present invention is to provide a toner having solved the above problems, and an image forming method and an appratus unit which make use of such a toner.

Another object of the present invention is to provide a toner that does not cause any increase in fog, faulty cleaning and lowering of transfer efficiency even in long-term service and also does not cause any decrease in image density and any uneven images even in environment of low humidity, and an image forming method and an appratus unit which make use of such a toner.

To achieve the objects of the present invention, the present invention provides a toner comprising toner particles and an external additive, wherein;

the toner particles have a weight-average particle diameter of from 4 $\mu$m to 9 $\mu$m; and the external additive has (i) first, small-particle-diameter hydrophobic fine silica particles (A) having a BET specific surface area of from 100 $m^2/g$ to 350 $m^2/g$, having been treated with a silane, (ii) second, large-particle-diameter hydrophobic fine silica particles (B) having a BET specific surface area of from 15 $m^2/g$ to 80 $m^2/g$, having been treated with a silicone oil, and (iii) fine alumina particles (C) having a BET specific surface area of from 50 $m^2/g$ to 150 $m^2/g$.

The present invention also provides a toner comprising toner particles and an external additive, wherein;

the toner particles have a weight-average particle diameter of from 4 $\mu$m to 9 $\mu$m; and the external additive has (i) first, small-particle-diameter hydrophobic fine silica particles (A) having a primary particle 50% particle diameter of from 5 nm to 20 nm, having been treated with a silane, (ii) second, large-particle-diameter hydrophobic fine silica particles (B) having a primary particle 50% particle diameter of from 30 nm to 150 nm, having been treated with a silicone oil, and (iii) fine alumina particles (C) having a BET specific surface area of from 50 $m^2/g$ to 150 $m^2/g$.

The present invention still also provides an image forming method comprising;

an electrostatic latent image forming step of forming an electrostatic latent image on a latent image bearing member; and a developing step of developing with a toner the electrostatic latent image formed on the latent image bearing member;

wherein;

in the developing step, the toner is fed onto a developer carrying member by means of a developer feed roller brought into contact with the developer carrying member, the layer thickness of the toner is regulated by means of a developer layer thickness regulating member brought into touch with the surface of the developer carrying member, and the electrostatic latent image is developed with the toner of a layer-thickness-regulated toner layer, carried on the developer carrying member; and the toner has toner particles and an external additive;

the toner particles having a weight-average particle diameter of from 4 $\mu$m to 9 $\mu$m ; and the external additive having (i) first, small-particle-diameter hydrophobic fine silica particles (A) having a BET specific surface area of from 100 $m^2/g$ to 350 $m^2/g$, having been treated with a silane, (ii) second, large-particle-diameter hydrophobic fine silica particles (B) having a BET specific surface area of from 15 $m^2/g$ to 80 $m^2/g$, having been treated with a silicone oil, and (iii) fine alumina particles (C) having a BET specific surface area of from 50 $m^2/g$ to 150 $m^2/g$.

The present invention further provides an image forming method comprising;

an electrostatic latent image forming step of forming an electrostatic latent image on a latent image bearing member; and a developing step of developing with a toner the electrostatic latent image formed on the latent image bearing member;

wherein;

in the developing step, the toner is fed onto a developer carrying member by means of a developer feed roller brought into contact with the developer carrying member, the layer thickness of the toner is regulated by means of a developer layer thickness regulating member brought into touch with the surface of the developer carrying member, and the electrostatic latent image is developed with the toner of a layer-thickness-regulated toner layer, carried on the developer carrying member; and the toner has toner particles and an external additive;

the toner particles having a weight-average particle diameter of from 4 $\mu$m to 9 $\mu$m ; and the external additive having (i) first, small-particle-diameter hydrophobic fine silica particles (A) having a primary particle 50% particle diameter of from 5 nm to 20 nm, having been treated with a silane, (ii) second, large-particle-diameter hydrophobic fine silica particles (B) having a primary particle 50% particle diameter of from 30 nm to 150 nm, having been treated with a silicone oil, and (iii) fine alumina particles (C) having a BET specific surface area of from 50 $m^2/g$ to 150 $m^2/g$.

The present invention still further provides an apparatus unit detachably mountable on the main assembly of an image forming apparatus; the unit comprising;

a toner;

a developer container for holding the toner; and a developer carrying member for carrying thereon the toner held in the developer container and transporting the toner to a developing zone;

wherein;

the toner has toner particles and an external additive;

the toner particles having a weight-average particle diameter of from 4 $\mu$m to 9 $\mu$m; and the external additive having (i) first, small-particle-diameter hydrophobic fine silica particles (A) having a BET specific surface area of from 100 $m^2/g$ to 350 $m^2/g$, having been treated with a silane, (ii) second, large-particle-diameter hydrophobic fine silica particles (B) having a BET specific surface area of from 15 $m^2/g$ to 80 $m^2/g$, having been treated with a silicone oil, and (iii) fine alumina particles (C) having a BET specific surface area of from 50 $m^2/g$ to 150 $m^2/g$.

The present invention still further provides an apparatus unit detachably mountable on the main assembly of an image forming apparatus; the unit comprising;

a toner;

a developer container for holding the toner; and a developer carrying member for carrying thereon the toner held in the developer container and transporting the toner to a developing zone;

wherein;

the toner has toner particles and an external additive;

the toner particles having a weight-average particle diameter of from 4 $\mu$m to 9 $\mu$m; and the external additive having (i) first, small-particle-diameter hydrophobic fine silica particles (A) having a primary particle 50% particle diameter of from 5 nm to 20 nm, having been treated with a silane, (ii) second, large-particle-diameter hydrophobic fine silica particles (B) having a primary particle 50% particle diameter of from 30 nm to 150 nm, having been treated with a silicone oil, and (iii) fine alumina particles (C) having a BET specific surface area of from 50 $m^2/g$ to 150 $m^2/g$.

DESCRIPTION OF THE PREFERRED EMBODIMENTS

Figure 1:
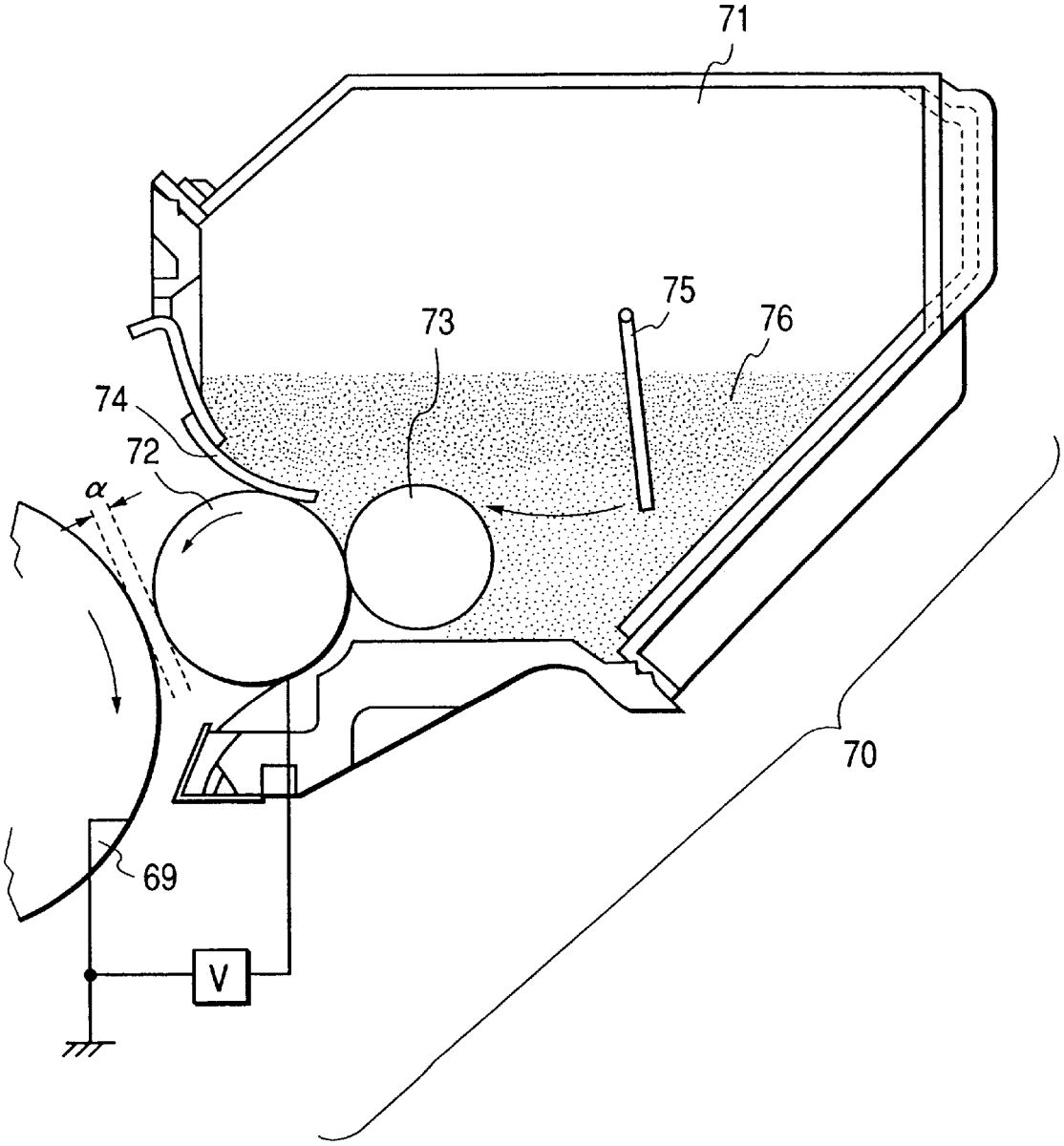
FIG. 1 illustrates a developing assembly used in non-magnetic one-component development making use of the toner of the present invention.

As a result of extensive studies made by the present inventors, it has been found that the use of two types of hydrophobic silica fine particles having specific BET specific surface areas, having been subjected to specific treatment, and fine alumina particles having a specific BET specific surface area, or the use of two types of hydrophobic silica fine particles having specific primary particle 50% particle diameters, having been subjected to specific treatment, and fine alumina particles having a specific BET specific surface area, makes it possible to obtain images without causing any increase in fog, faulty cleaning and lowering of transfer efficiency even in long-term service and also causing any decrease in image density and any uneven images even in environment of low humidity.

The two types of hydrophobic silica fine particles are herein grouped as particles (A) and (B), i.e., small-particle-diameter hydrophobic fine silica particles (A) and large-particle-diameter hydrophobic fine silica particles (B). The fine alumina particles are used as particles (C).

As the small-particle-diameter hydrophobic fine silica particles (A), used are hydrophobic fine silica particles having a BET specific surface area of from 100 to 350 $m^2/g$, and preferably from 150 to 300 $m^2/g$, having been surface-treated with a silane, or hydrophobic fine silica particles having a primary particle 50% particle diameter of from 5 nm to 20 nm, having been surface-treated with a silane. Use of such particles as an external additive of the toner enables control of charging performance and fluidity of toner to provide the toner with good developing performance, cleaning performance and transfer performance.

If the small-particle-diameter hydrophobic fine silica particles (A) have a BET specific surface area larger than 350 $m^2/g$ or have a primary particle 50% particle diameter smaller than 5 nm, the particles may be buried in microscopic unevenness of toner particle surfaces to enable no sufficient control of charging performance and fluidity, undesirably. If the small-particle-diameter hydrophobic fine silica particles (A) have a BET specific surface area smaller than 100 $m^2/g$ or have a primary particle 50% particle diameter larger than 20 nm, the particles may provide the toner with no sufficient fluidity, undesirably.

The silane for treating the surfaces of the small-particle-diameter hydrophobic fine silica particles (A) may preferably be an alkoxysilane, a silazane or a chlorosilane, and more preferably be a disilazane. Treatment with a silane coupling agent, a titanium coupling agent or a silicone oil is not preferable because it can not provide the toner with any sufficient fluidity.

The treatment with the silicone oil may preferably be made in an amount of from 5 to 25 parts by weight, and more preferably from 8 to 20 parts by weight, based on 100 parts by weight of the fine silica particles. In this treatment, the small-particle-diameter hydrophobic fine silica particles (A) may preferably have a water-wettability of 70% or above. If the fine silica particles (A) have a water-wettability below 70%, no sufficient charge quantity may be attained in an environment of high humidity.

As the large-particle-diameter hydrophobic fine silica particles (B), which is an additional external additive, used are hydrophobic fine silica particles having a BET specific surface area of from 15 to 80 $m^2/g$, and preferably from 20 to 60 $m^2/g$, having been surface-treated with a silicone oil, or hydrophobic fine silica particles having a primary particle 50% particle diameter of from 30 nm to 150 nm, having been surface-treated with a silicone oil.

If the large-particle-diameter hydrophobic fine silica particles (B) have a BET specific surface area larger than 80 $m^2/g$ or have a primary particle 50% particle diameter smaller than 30 nm, the spacer effect to be expected by the addition of the large-particle-diameter hydrophobic fine silica particles (B) may not be seen, undesirably. If the large-particle-diameter hydrophobic fine silica particles (B) have a BET specific surface area smaller than 15 $m^2/g$ or have a primary particle 50% particle diameter larger than 150 nm, many particles may become released from toner particle surfaces, undesirably.

In the present invention, silica must be used as the large-particle-diameter hydrophobic fine silica particles (B). Use of inorganic fine particles other than the silica, e.g., titanium oxide, alumina, tin oxide, zinc oxide, magnesium oxide or strontium titanate, is not preferable because many particles thereof may become released from toner particle surfaces.

The large-particle-diameter hydrophobic fine silica particles (B) used in the present invention have been surface-treated with a silicone oil. This can prevent the large-particle-diameter hydrophobic fine silica particles (B) from becoming released from toner particle surfaces. Treatment with only some other than the silicone oil (e.g., with an alkoxysilane, a silazane or a coupling agent) is not preferable because many large-particle-diameter hydrophobic fine silica particles (B) may become released from toner particle surfaces.

As the silicone oil for surface-treating the large-particle-diameter hydrophobic fine silica particles (B), dimethylsilicone oil, methylphenylsilicone oil or methylhydrogensilicone oil may be used. In particular, dimethylsilicone oil is preferred. The silicone oil may preferably have a viscosity of 100 cSt or below at 25° C.

The treatment with the silicone oil may preferably be made in an amount of from 2 to 20 parts by weight, and more preferably from 5 to 15 parts by weight, based on 100 parts by weight of the fine silica particles. In this treatment, the large-particle-diameter hydrophobic fine silica particles (B) may preferably have a water-wettability of 80% or above. If the fine silica particles (B) have a water-wettability below 80%, such particles may have a weak adhesion to toner particle surfaces in an environment of high humidity to tend to become released therefrom.

The small-particle-diameter hydrophobic fine silica particles (A) may preferably be added to the toner in an amount (a) of from 0.3 to 2.5 parts by weight, and more preferably from 0.5 to 2.0 parts by weight, based on 100 parts by weight of the toner particles. Addition of the small-particle-diameter hydrophobic fine silica particles (A) in an amount (a) less than 0.3 part by weight may make it difficult to attain a sufficient fluidity, and their addition in an amount (a) more than 2.5 parts by weight may cause surplus silica which does not adhere completely to toner particle surfaces, to tend to cause photosensitive member filming and sleeve contamination.

The large-particle-diameter hydrophobic fine silica particles (B) may preferably be added to the toner in an amount (b) of from 0.05 to 1.5 parts by weight, and more preferably from 0.1 to 1.0 part by weight, based on 100 parts by weight of the toner particles. Addition of the large-particle-diameter hydrophobic fine silica particles (B) in an amount (b) less than 0.05 part by weight may bring about no sufficient spacer effect, and their addition in an amount (b) more than 1.5 parts by weight may cause surplus silica which does not adhere completely to toner particle surfaces, to tend to cause photosensitive member filming and sleeve contamination.

As described above, the large-particle-diameter hydrophobic fine silica particles (B) can be restrained from becoming released from toner particle surfaces under selection of their BET specific surface area and surface treatment. Here, the large-particle-diameter hydrophobic fine silica particles (B) may have a quantity of triboelectricity of from −60 to −100 mC/kg. Those having the like BET specific surface area but not making use of the silicone oil as a treating agent have a quantity of triboelectricity of about −30 to −50 mC/kg. Such a higher absolute value of quantity of triboelectricity is considered to effectively prevent the particles (B) from becoming released from toner particle surfaces.

If the large-particle-diameter hydrophobic fine silica particles (B) have a quantity of triboelectricity smaller than −60 mC/kg as an absolute value in minus, the large-particle-diameter hydrophobic fine silica particles (B) tend to become released from toner particle surfaces. If the large-particle-diameter hydrophobic fine silica particles (B) have a quantity of triboelectricity larger than −100 mC/kg as an absolute value in minus, they may mutually electrostatically agglomerate to become hard to adhere uniformly to toner particle surfaces.

The small-particle-diameter hydrophobic fine silica particles (A) may preferably have a quantity of triboelectricity of from −40 to −150 mC/kg.

If the small-particle-diameter hydrophobic fine silica particles (A) have a quantity of triboelectricity smaller than −40 mC/kg as an absolute value in minus, the small-particle-diameter hydrophobic fine silica particles (A) tend to become released from toner particle surfaces when a stress is applied to toner particles. If the small-particle-diameter hydrophobic fine silica particles (A) have a quantity of triboelectricity larger than −150 mC/kg as an absolute value in minus, the toner particles tend to cause charge-up in an environment of low humidity.

In the present invention, as a further external additive in addition to the above two types of fine silica particles, fine alumina particles having a BET specific surface area of from 50 to 150 $m^2/g$ are used as the fine alumina particles (C). This can restrain the toner from causing charge-up especially in an environment of low humidity.

If the fine alumina particles (C) have a BET specific surface area smaller than 50 $m^2/g$, the fine alumina particles (C) may become released from toner particle surfaces to selectively participate in development, resulting in a smaller quantity of their presence to cause a decrease in image density or cause uneven images ascribable to the charge-up of toner in an environment of low humidity. If the fine alumina particles (C) have a BET specific surface area larger than 150 $m^2/g$, the fine alumina particles (C) may cover the large-particle-diameter hydrophobic fine silica particles (B) to obstruct the latter's adhesion to toner particle surfaces, undesirably.

The fine alumina particles (C) may preferably have a quantity of triboelectricity of from −30 to +20 mC/g, and more preferably from −10 to +10 mC/g. This is effective for restraining the charge-up of toner.

If the fine alumina particles (C) have a quantity of triboelectricity greater than −30 mC/g as an absolute value in minus, it may be difficult to restrain the charge-up of toner in an environment of low humidity. If they have a quantity of triboelectricity greater than +20 mC/g as an absolute value in plus, they may agglomerate electrostatically with the small-particle-diameter hydrophobic fine silica particles (A) and large-particle-diameter hydrophobic fine silica particles (B).

The fine alumina particles (C) may preferably be added in the toner in an amount of from 0.01 to 2.0 parts by weight, and more preferably from 0.03 to 1.5 parts by weight, based on 100 parts by weight of the toner particles.

If the fine alumina particles (C) are added in an amount less than 0.01 part by weight, it may be difficult to restrain the toner from charge-up in an environment of low humidity. If they are added in an amount more than 2.0 parts by weight, the toner can not have any sufficient charge quantity in an environment of high humidity, tending to cause fog.

In the present invention, the small-particle-diameter hydrophobic fine silica particles (A), large-particle-diameter hydrophobic fine silica particles (B) and fine alumina particles (C) which are used as external additives may preferably be added in amount (a), amount (b) and amount (c), respectively, in the ratio satisfying the following relationship:

a:b:c=1:0.10 to 0.65:0.05 to 0.50 and more preferably satisfying the following relationship:

a:b:c=1:0.15 to 0.45:0.05 to 0.40.

If the large-particle-diameter hydrophobic fine silica particles (B) is added in an amount (b) less than 0.10, the spacer effect may be so insufficient as to tend to cause a decrease in image density and cause fog, as a result of running. If it is added in an amount (b) more than 0.65, the toner may have a low fluidity to tend to cause uneven image density.

If the fine alumina particles (C) is added in an amount (c) less than 0.05, the charge-up of toner tends to occur in an environment of low humidity to tend to cause a decrease in image density and cause fog. If it is added in an amount (c) more than 0.5, the charge quantity of toner may lower in an environment of high humidity to tend to cause fog greatly.

The addition of the fine alumina particles (C) brings about superior performance in an environment of low humidity as stated above. In order to make the performance less differ from that in an environment of high humidity, the fine alumina particles (C) may more preferably have a water-wettability not more than 30%. Use of the fine alumina particles (C) having a water-wettability not more than 30% makes it possible to prevent the charge-up of toner in an environment of low humidity by its addition in a small quantity and at the same time to especially restrain the charging performance of toner from lowering in an environment of high humidity, so that the decrease in image density or the fog can be prevented from occurring.

Fine alumina particles (C) having a water-wettability more than 30% may preferably be added to the toner in an amount (c1) of from 0.05 to 2.0 parts by weight, and more preferably from 0.07 to 1.5 parts by weight, based on 100 parts by weight of the toner particles. When on the other hand the fine alumina particles (C) having a water-wettability not more than 30% is used, charges of toner can be made to leak appropriately by its addition in a small quantity, and hence they may preferably be added to the toner in an amount (c2) of from 0.01 to 1.0 part by weight, and more preferably from 0.03 to 0.7 part by weight, based on 100 parts by weight of the toner particles.

Accordingly, with regard to the above ratio of amount (a), amount (b) and amount (c) of the small-particle-diameter hydrophobic fine silica particles (A), large-particle-diameter hydrophobic fine silica particles (B) and fine alumina particles (C), their preferable ratio differs between the amount (c1) and the amount (c2) when the fine alumina particles (C) have a water-wettability more than 30% and when the fine alumina particles (C) have a water-wettability not more than 30%, respectively. Stated specifically, when the fine alumina particles (C) have a water-wettability more than 30%, the ratio may preferably satisfy the following relationship:

a:b:c1=1:0.10 to 0.65:0.20 to 0.50 and more preferably satisfy the following relationship:

a:b:c1=1:0.15 to 0.45:0.30 to 0.40.

When the fine alumina particles (C) have a water-wettability not more than 30%, the ratio may preferably satisfy the following relationship:

a:b:c2=1:0.10 to 0.65:0.05 to 0.35 and more preferably satisfy the following relationship:

a:b:c2=1:0.15 to 0.45:0.05 to 0.25.

In the present invention, the BET specific surface area of the fine particles is measured by adsorbing nitrogen gas on sample surfaces, using a specific surface area measuring device AUTOSOBE 1 (manufactured by Yuasa Ionics Co.), and the specific surface area is calculated by the BET multiple point method.

In the present invention, the primary particle 50% particle diameter of the fine silica particles is measured using a transmission electron microscope. A photograph is taken at 150,000 magnifications, and the photograph taken is further enlarged by four times to measure particle diameters of primary particles. This is measured on 100 samples, and a 50% value of the measurements is regarded as the primary particle 50% particle diameter.

In the present invention, the quantity of triboelectricity of the external additive fine particles is measured in the following way.

A mixture of external additive fine particles and a carrier is put in a bottle with a volume of 50 ml, made of polyethylene, and manually shaked for about 5 minutes. Here, as the carrier, a silicone-coated ferrite carrier (a 400 mesh-pass product) is used, and the external additive fine particles and the carrier are mixed in a weight ratio of 2:98.

Figure 3:
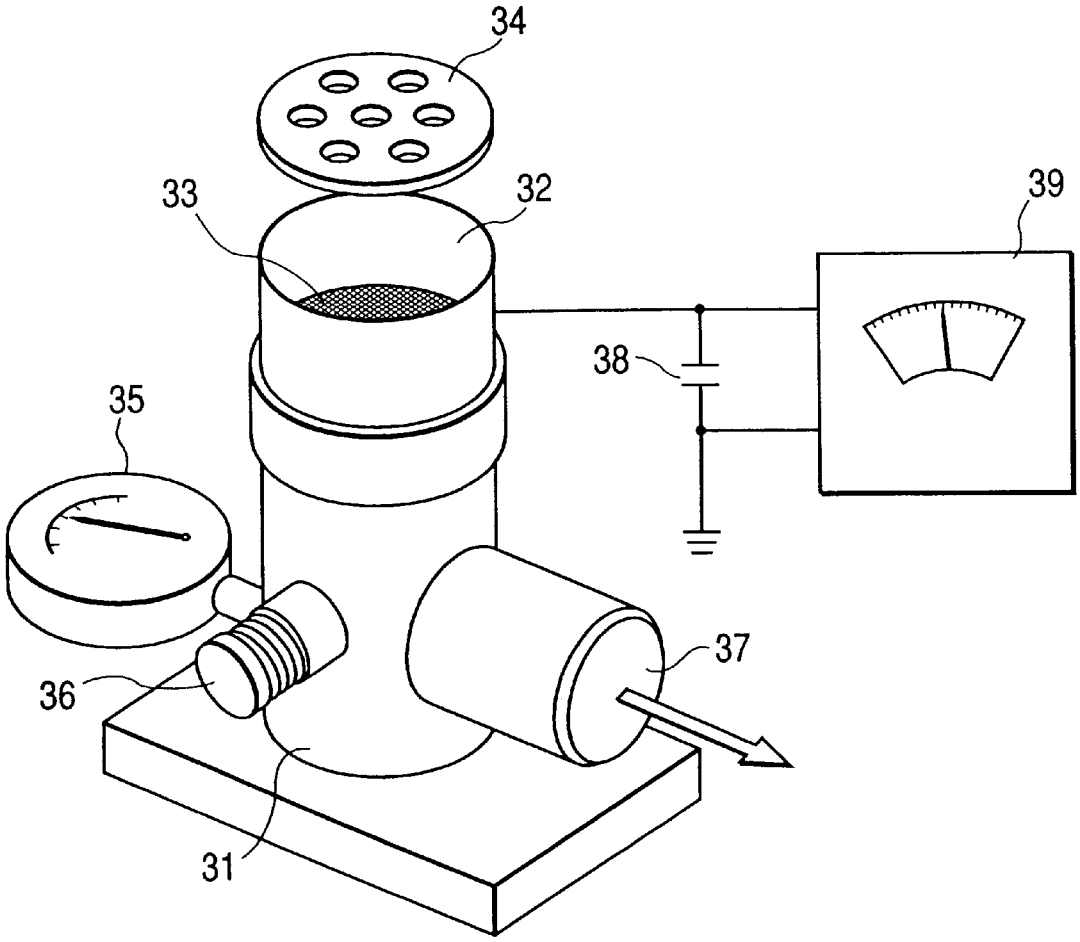
FIG. 3 illustrates a device for measuring the quantity of triboelectricity of external additives fine particles used in the present invention.

Next, as shown in FIG. 3, the mixture in an amount of $W_0$ (g: about 0.5 to 1.5 g) is put in a measuring container 32 made of a metal at the bottom of which a screen 33 of 500 meshes is provided, and the container is covered with a plate 34 made of a metal. The total weight of the measuring container 32 at this time is weighed and is expressed as $W_1$ (g). Next, in a suction device 31 (made of an insulating material at least at the part coming into contact with the measuring container 32), air is sucked from a suction opening 37 and an air-flow control valve 36 is operated to control the pressure indicated by a vacuum indicator 35, to be 2,450 hPa. In this state, suction is well carried out, preferably for 2 minutes, to remove the external additive fine particles by suction.

Quantity of triboelectricity Q of the external additive fine particles in this suction, when corrected 100%, is defined as follows:

$$Q = \frac{(W_1 - W_2)}{T \times W_0} \times \frac{C \times V}{(W_1 - W_2)} = \frac{C \times V}{T \times W_0}$$

V (volt): potential indicated by a potentiometer 39;

C ($\mu$F): capacitance of a capacitor 38;

$W_2$ (g): weight of the measuring container after suction; and

T: particles/carrier ratio.

In the present invention, the water-wettability of fine particles is measured in the following way.

In a 200-ml separating funnel, 1.0 g of a sample is put, and 100 ml of ion-exchanged water is added thereto. The separating funnel is set in a tumbling shaker mixer (manufactured by Shinmaru Enterprises Co.) to carry out dispersion at 90 rpm for 10 minutes. The separating funnel is taken out, and is left for 10 minutes. Thereafter, a 20 to 30 ml portion is sampled, and is dispensed in a 10 mm cell of a spectrophotometer UV-210 (manufactured by Shimadzu Corporation). Using ion-exchanged water as a blank, the turbidity of water layer is measured at a wavelength of 500 nm, and the value read in this measurement is regarded as the water-wettability.

In the present invention, the toner particles may preferably have a weight-average particle diameter of from 4 to 9 $\mu$m. If the toner particles have a weight-average particle diameter smaller than 4 $\mu$m, uneven images or fog may seriously occur because of non-uniform charging. If they have a weight-average particle diameter larger than 9 $\mu$m, toner spots around fine line images may seriously occur, undersirably.

In the present invention, the weight-average particle diameter of the toner is measured with a Coulter counter Model TA-II (manufactured by Coulter Electronics, Inc.). An interface (manufactured by Nikkaki k.k.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (trade name, manufactured by Coulter Scientific Japan Co.) may be used. Measurement is made by adding as a dispersant 0.1 to 5 ml of a surface active agent, preferably an alkylbenzene sulfonate, to 100 to 150 ml of the above aqueous electrolytic solution, and further adding 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with diameters of 2 $\mu$m or larger by means of the above Coulter counter Model TA-II, using an aperture of 100 $\mu$m as its aperture. Then, as the value according to the present invention, the weight-based, weight average particle diameter (D4) (the middle value of each channel is used as the representative value for each channel) determined from the volume distribution is determined.

As channels, 13 channels are used, which are of 2.00 to less than 2.52 $\mu$m, 2.52 to less than 3.17 $\mu$m, 3.17 to less than 4.00 $\mu$m, 4.00 to less than 5.04 $\mu$m, 5.04 to less than 6.35 $\mu$m, 6.35 to less than 8.00 $\mu$m, 8.00 to less than 10.08 $\mu$m, 10.08 to less than 12.70 $\mu$m, 12.70 to less than 16.00 $\mu$m, 16.00 to less than 20.20 $\mu$m, 20.20 to less than 25.40 $\mu$m, 25.40 to less than 32.00 $\mu$m, and 32.00 to less than 40.30 $\mu$m.

In the present invention, the toner may preferably have an average circularity of from 0.950 to 1.000, more preferably from 0.950 to 0.990, and still more preferably from 0.960 to 0.985 as measured with a flow type particle image analyzer. If the toner has an average circularity less than 0.950, it tends to cause uneven images and fog due to non-uniform charging. If it has an average circularity more than 0.990, it tends to cause a lowering of cleaning performance.

The circularity referred to in the present invention is used as a simple method for expressing the shape of toner quantitatively. In the present invention, it is measured with a flow type particle image analyzer FPIA-1000, manufactured by Toa Iyou Denshi K.K., and the circularity of particles measured is calculated according to the expression shown below, and the sum total of circularity of all particles measured is divided by the whole number of particles, and the value obtained is defined as the average circularity.

$$\text{Circularity} = \frac{\text{Circumferential length of a circle with the same projected area as particle image}}{\text{Circumferential length of particle projected image}}$$

The average circularity is measured with the flow type particle image analyzer FPIA-1000, manufactured by Toa Iyou Denshi K.K. The toner whose average circularity is to be measured is weighed in an amount of about 0.02 g, and is uniformly dispersed in ion-exchanged water containing a surface-active agent in a small quantity (about 10 ml, 20° C.). As a means for the dispersion, an ultrasonic dispersion machine UH-50, manufactured by SMT Co., is used (a 5 mm diameter titanium alloy tip is used as a vibrator), and dispersion time is set to be 5 minutes or longer, where the dispersion is appropriately cooled so that the dispersion medium temperature does not exceed 40° C. Using the flow type particle image analyzer, at least 1,000 particles having circularity-corresponding diameters of from 0.66 μm to 159.21 μm are picked up to measure their average circularity.

The summary of measurement is described in a catalog of FPIA-1000, published by Toa Iyoudenshi K.K. (1995, June Edition), an operation manual of the measuring apparatus and Japanese Patent Application Laid-open No. 8-136439, and is as follows:

The sample dispersion is passed through channels (extending along the flow direction) of a flat transparent flow cell (thickness: about 200 μm). A strobe and a CCD (charge-coupled device) camera are fitted at positions opposite to each other with respect to the flow cell so as to form a light path that passes crosswise with respect to the thickness of the flow cell. During the flowing of the sample dispersion, the dispersion is irradiated with strobe light at intervals of 1/30 seconds to obtain an image of the particles flowing through the cell, so that a photograph of each particle is taken as a two-dimensional image having a certain range parallel to the flow cell. From the area of the two-dimensional image of each particle, the diameter of a circle having the same area is calculated as the circle-corresponding diameter.

The circularity of each particle is calculated from the projected area of two-dimensional image of each particle and the circumferential length of projected image, using the above circularity calculation formula.

The measuring device FPIA-1000 used in the present invention utilizes a calculation method in which the circularity of each particle is calculated, thereafter in a calculation of the average circularity the particles obtained having the circularity of 0.4 to 1.0 are classified into 61-divided classes, and the average cirdularity is calculated by employing middle point of divided points and a frequency. However, the differences between the average circularity calculated by this calculation method and the average circularity calculated by utilizing the calculation formula in which the circularity of particles is directly employed as mentioned above is very smaller and can be substantially negligible. In the present invention, the caluculation formula in which the circularity of particles is directly used is utilized because of dealing with the data such as shortening of calculation time and simplification of calculation formula, but this calculation method partially modified may be employed in the present invention.

There are no particular limitations on how to produce the toner particles used in the present invention. In order to make the toner have the average circularity of 0.950 or more, and preferably from 0.95 to 0.990, the toner particles may preferably be produced by suspension polymerization, mechanical pulverization or spherical treatment. In particular, suspension polymerization is preferred.

A process for producing the toner particles by suspension polymerization is described below.

First, a polymerizable monomer composition comprising polymerizable monomers and added therein a low-softening substance, a polar resin, a colorant, a charge control agent, a polymerization initiator and other additives, having been uniformly dissolved or dispersed by means of a homogenizer or an ultrasonic dispersion machine, is dispersed in an aqueous phase containing a dispersion stabilizer, by means of a mixing machine such as a usual agitator, homomixer or homogenizer. Here, granulation is carried out while controlling agitation speed and time so that droplets formed of the polymerizable monomer composition can have the desired toner particle size. After the granulation, agitation may be carried out to such an extent that the state of particles is maintained by the action of the dispersion stabilizer and the particles can be prevented from settling. The polymerization may be carried out at a polymerization temperature set at 40° C. or above, preferably from 50 to 90° C. At the latter half of the polymerization, the temperature may be raised, and also the aqueous medium may be removed in part from the reaction system at the latter half of the reaction or after the reaction has been completed, in order to remove unreacted polymerizable monomers and by-products which may cause a smell at the time of developer fixing. After the reaction has been completed, the toner particles formed are collected by washing and filtration, followed by drying. In such suspension polymerization, water may usually be used as the dispersion medium preferably in an amount of from 300 to 3,000 parts by weight based on 100 parts by weight of the polymerizable monomer composition.

The particle size distribution and particle diameter of the toner particles may be controlled by a method in which the type or amount of a slightly water-soluble inorganic salt or a dispersant having the action of protective colloids is changed; or a method in which mechanical device conditions, e.g., agitation conditions such as the peripheral speed of a rotor, pass times and the shape of agitating blades and the shape of a reaction vessel, or the concentration of solid matter in the aqueous medium, thus the intended toner particles used in the present invention can be obtained.

The polymerizable monomer used in the present invention may include styrene monomers such as styrene, o-, m- or p-methylstyrene, and m- or p-ethylstyrene; acrylic or methacrylic ester monomers such as methyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and olefin monomers such as butadiene, isoprene, cyclohexene, acrylo- or methacrylonitrile and acrylic acid amide, any of which may preferably be used.

As the polar resin added at the time of polymerization, preferably usable are styrene-acrylic or methacrylic acid copolymers, maleic acid copolymers, polyester copolymers and epoxy copolymers.

The low-softening substance used in the present invention may include paraffin wax, polyolefin wax, Fischer-Tropsch wax, amide waxes, higher fatty acids, ester waxes, and derivatives of these, or graft or block compounds of these.

As the colorant used in the toner particles of the present invention, carbon black and colorants toned in black by the use of yellow, magenta and cyan colorants shown below are used as black colorants.

As the yellow colorant, compounds typified by condensation azo compounds, isoindolinone compounds, anthraquinone compounds, azo metal complexes, methine compounds or allylamide compounds are used. Stated specifically, C.I. Pigment Yellow 12, 13, 14, 15, 17, 62, 74, 83, 93, 94, 95, 109, 110, 111, 128, 129, 147, 168 and 180 are preferably used.

As the magenta colorant, condensation azo compounds, diketopyrrolopyyrole compounds, anthraquinone compounds, quinacridone compounds, basic dye lake compounds, naphthol compounds, benzimidazole compounds, thioindigo compounds or perylene compounds are used. Stated specifically, C.I. Pigment Red 2, 3, 5, 6, 7, 23, 48:2, 48:3, 48:4, 57:1, 81:1, 122, 144, 146, 166, 169, 177, 184, 185, 202, 206, 220, 221 and 254 are particularly preferable.

As the cyan colorant, copper phthalocyanine compounds and derivatives thereof, anthraquinone compounds or basic dye lake compounds may be used. Stated specifically, C.I. Pigment Blue 1, 7, 15, 15:1, 15:2, 15:3, 15:4, 60, 62 and 66 may particularly preferably be used.

Any of these colorants may be added in an amount of from about 1 to 20 parts by weight based on 100 parts by weight of the polymerizable monomer. In the case when a magnetic material is used as the black colorant, it may be added, different from other colorants, in an amount of from about 40 to 150 parts by weight based on 100 parts by weight of the polymerizable monomer.

As charge control agents used in the present invention, known agents may be used. Charge control agents having neither polymerization inhibitory action nor solubilizates in the aqueous dispersion medium are particularly preferred. As specific compounds, usable are, as negative ones, metal compounds of salicylic acid, naphthoic acid, dicarboxylic acid and derivatives thereof, polymeric compounds having sulfonic acid or carboxylic acid in the side chain, boron compounds, urea compounds, silicon compounds, and carycsarene. As positive ones, preferably usable are quaternary ammonium salts, polymer type compounds having such a quaternary ammonium salt in the side chain, guanidine compounds, and imidazole compounds. The charge control agent may preferably be used in an amount of from 0.5 to 10 parts by weight based on 100 parts by weight of the polymerizable monomer.

The polymerization initiator used in the present invention may include, e.g., azo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide.

The polymerization initiator may usually be added in an amount of from 0.5 to 20% by weight based on the weight of the monomers, which varies depending on the degree of polymerization intended in the present invention. The polymerization initiator may a little vary in type depending on the methods for polymerization, and may be used alone or in the form of a mixture, making reference to its 10-hour half-life period temperature.

The dispersant used when the suspension polymerization is used may include, e.g., as inorganic oxide compounds, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, magnetic materials and ferrite. As organic compounds, it may include, e.g., polyvinyl alcohol, gelatin, methyl cellulose, methyl hydroxypropyl cellulose, ethyl cellulose, carboxymethyl cellulose sodium salt, and starch, which are dispersed in the aqueous phase when used.

Any of these stabilizers may preferably be used in an amount of from 0.2 to 2.0 parts by weight based on 100 parts by weight of the polymerizable monomer.

As these dispersants, those commercially available may be used as they are. In order to obtain dispersed particles having a fine and uniform particle size, however, fine particles of the inorganic compound may be formed in the dispersion medium under high-speed agitation. For example, in the case of tricalcium phosphate, an aqueous sodium phosphate solution and an aqueous calcium chloride solution may be mixed under high-speed agitation to obtain a fine-particle dispersant preferable for the suspension polymerization.

In order to make these dispersants finer, 0.001 to 0.1 part by weight of a surface active agent may be used in combination. Stated specifically, commercially available nonionic, anionic or cationic surface active agents may be used. For example, those preferably used are sodium dodecylsulfate, sodium tetradecylsulfate, sodium pentadecylsulfate, sodium octylsulfate, sodium oleate, sodium laurate, potassium stearate and calcium oleate.

A process for producing the toner particles by pulverization (pulverization toner particles) is described below.

The pulverization toner particles are produced using a binder resin, a colorant, a charge control agent and other additives.

The binder resin used in the pulverization toner particles in the present invention may include polystyrene, poly-α-methylstyrene, styrene-propylene copolymer, styrene-butadiene copolymer, styrene-vinyl chloride copolymer, styrene-vinyl acetate copolymer, styrene-acrylate copolymer, styrene-methacrylate copolymer, vinyl chloride resins, polyester resins, epoxy resins, phenol resins and polyurethane resins, any of which may be used alone or in the form of a mixture. In particular, styrene-acrylate copolymer, styrene-methacrylate copolymer and polyester resins are preferred.

As the colorant used in the present invention, any known colorants may be used, including, e.g., carbon black; oil-soluble dyes such as C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, C.I. Pigment Violet 19, C.I. Vat Red 1, 2, 10, 13, 15, 23, 29, 35, C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1; basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28; C.I. Pigment Blue 2, 3, 15, 16, 17; C.I. Vat Blue 6; C.I. Acid Blue 45; C.I. Pigment Yellow 1, 2, 3, 4, 5, 6, 7, 10, 11, 12, 13, 14, 15, 16, 17, 23, 65, 73, 83; and C.I. Vat Yellow 1, 3, 20; any of which may be used alone or in the form of a mixture.

The colorant may be used in an mount of from 0.1 to 60 parts by weight, and preferably from 0.5 to 50 parts by weight based on 100 parts by weight of the binder resin.

Positive charge control agents added when the toner particles used in the present invention are controlled to be positively chargeable may include Nigrosine dyes; products modified with fatty acid metal salts; quaternary ammonium salts such as tributylbenzylammonium 1-hydroxy-4-naphthosulfonate and tetrabutylammonium teterafluoroborate, and analogues of these, including onium salts such as phosphonium salts, and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); amine and polyamine compounds; metal salts of higher fatty acids; acetylacetone metal complexes; diorganotin oxides such as dibutyltin oxide, dioctyltin oxide and dicyclohexyltin oxide; and diorganotin borates such as dibutyltin borate, dioctyltin borate and dicyclohexyltin borate.

As negative charge control agents added when the toner particles used in the present invention are controlled to be negatively chargeable, organic metal complexes or chelate compounds are effective, which may specifically include monoazo metal complexes, acetylacetone metal complexes, metal complexes of an aromatic hydroxycarboxylic acid type or aromatic dicarboxylic acid type, aromatic hydroxycarboxylic acid, aromatic mono- or polycarboxylic acids and metal salts thereof, anhydrides thereof or esters thereof, and phenol derivatives such as bisphenol thereof.

Any of the charge control agents may be used in an amount of from 0.1 to 15 parts by weight, and preferably from 0.5 to 10 parts by weight based on 100 parts by weight of the binder resin.

A release agent may optionally be added to the pulverization toner particles in the present invention. It may include, e.g., aliphatic hydrocarbon waxes or oxides thereof such as low-molecular weight polyethylene, low-molecular weight polypropylene, paraffin wax and Fischer-Tropsh wax; waxes mainly composed of a fatty acid ester, such as carnauba wax and montanic acid ester wax, or those obtained by subjecting part or the whole thereof to deoxydation treatment; saturated straight-chain fatty acids such as palmitic acid, stearic acid and montanic acid; unsaturated fatty acids such as brandinic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; fatty acid amides such as linolic acid amide; saturated fatty acid bisamides such as methylenebis(stearic acid amide); unsaturated fatty acid bisamides such as ethylenebis(oleic acid amide); aromatic bisamides such as N,N'-distearylisophthalic acid amide; fatty acid metal salts such as zinc stearate; grafted waxes obtained by grafting vinyl monomers such as styrene to aliphatic hydrocarbon waxes; partially esterified products of polyhydric alcohols with fatty acids, such as monoglyceride behenate; and methyl esterified products having a hydroxyl group, obtained by hydrogenation of vegetable fats and oils. The release agent may be added in an amount of from 0.1 to 20 parts by weight, and preferably from 0.5 to 10 parts by weight, based on 100 parts by weight of the binder resin.

Next, these binder resin, release agent, charge control agent and colorant are thoroughly mixed by means of a mixing machine such as a Henschel mixer or a ball mill to prepare a mixture, thereafter melt-kneading the mixture by means of a heat-kneading machine such as a heat roll, a kneader or an extruder to make resins melt one another and make the charge control agent and colorant disperse or dissolve therein, and cooling the resultant kneaded product to solidify, followed by fine pulverization by a mechanical means to have the desired particle size, and further followed by classification to make particle size distribution sharp. Alternatively, a finely pulverized product obtained by causing the cooled and solidified product to collide against a target under jet streams may be made spherical by heat or by mechanical impact force.

To the toner particles obtained by the processes described above, the small-particle-diameter hydrophobic fine silica particles (A), large-particle-diameter hydrophobic fine silica particles (B) and fine alumina particles (C) are externally added by, e.g., a method in which the particles are agitated using a high-speed agitation mixer such as Henschel mixer at a peripheral speed of about 20 to 50 m/s to make the latter particles (A) to (C) adhere to the former.

The toner of the present invention can be effective in any image forming methods. In particular, it can be most effective in the method described below.

It is an image forming method in which an electrostatic latent image formed on a latent image bearing member is developed using a one-component developing assembly having a developer coating blade serving as a developer layer thickness regulating member and a developer feed roller serving as a developer coating member which are brought into touch or contact with the surface of a developer carrying member. The toner is sent onto the developer carrying member by the developer feed roller, and then coated in thin layer on the developer coating blade, during which the toner is electrostatically charged. Any toner not participating in development and having remained on the developer carrying member is stripped off from the surface of the developer carrying member by the developer feed roller. This method enables uniform charging by thin-layer formation and hence can form good images with less fog, but has had a problem that the toner may deteriorate earlier to have a shorter toner life because of a greater stress the toner undergoes than other developing methods, e.g., two-component developing methods. The toner of the present invention is tough to such a stress and has a long life. Hence, it can be well effective when used in such a developing method.

The above developing method will be described below with reference to FIG. 1.

A developing assembly 70 has a developing container 71 for holding a non-magnetic one-component developer 76 as a non-magnetic toner, a developer carrying member 72 for carrying thereon the non-magnetic one-component developer 76 held in the developing container 71 and for transporting it to the developing zone, a feed roller 73 for feeding the non-magnetic one-component developer onto the developer carrying member, an elastic blade 74 as a developer layer thickness regulating member for regulating the thickness of a developer layer formed on the developer carrying member, and an agitating member 75 for agitating the non-magnetic one-component developer 76 held in the developing container 71.

Reference numeral 69 denotes a latent image bearing member for holding thereon electrostatic latent images, on which the electrostatic latent images are formed by an electrophotographic processing means or electrostatic recording means (not shown). Reference numeral 72 denotes a developing sleeve serving as the developer carrying member, and is comprised of a non-magnetic sleeve made of aluminum or stainless steel.

The developing sleeve as the developer carrying member may be prepared using a crude pipe of aluminum or stainless as it is, and may preferably be prepared by spraying glass beads on it to rough the surface uniformly, by mirror-finishing its surface or by coating its surface with a resin. In particular, the method of coating the sleeve surface with a resin may preferably be used because it enables easy adjustment of the surface roughness and conductivity of the sleeve and easy impartation of a lubricity to the sleeve surface by dispersing various particles in the resin.

There are no particular limitations on the resin used to coat the sleeve surface and the various particles added to the resin. As the resin, preferably usable are thermoplastic resins such as styrene resin, vinyl resin, polyether sulfone resin, polycarbonate resin, polyphenylene oxide resin, polyamide resin, fluorine resin, cellulose resin and acrylic resin; and thermo- or photosetting resins such as epoxy resin, polyester resin, alkyd resin, phenol resin, melamine resin, polyurethane resin, urea resin, silicone resin and polyimide resin.

As the various particles added thereto, preferably usable are particles of resins such as PMMA, acrylic resin, polybutadiene resin, polystyrene resin, polyethylene, polypropylene, polybutadiene, or a copolymer of any of these, benzoguanamine resin, phenol resin, polyamide resin, nylon, fluorine resin, silicone resin, epoxy resin and polyester resin; carbon black such as furnace black, lamp black, thermal black, acetylene black and channel black; metal oxides such as titanium oxide, tin oxide, zinc oxide, molybdenum oxide, potassium titanate, antimony oxide and indium oxide; metals such as aluminum, copper, silver and nickel; and inorganic fillers such as graphite, metal fiber and carbon fiber.

The non-magnetic one-component developer 76 is reserved in the developing container 71, and is fed onto the developer carrying member 72 by means of a feed roller 73. The feed roller 73 is comprised of a foamed material such as polyurethane foam, and is rotated at a relative speed that is not zero in the forward direction or backward direction with respect to the developer carrying member so that the developer can be fed onto the developer carrying member and also the developer remaining on the developer carrying member after transfer (the developer not participated in development) can be taken off. The non-magnetic one-component developer fed onto the developer carrying member 72 is coated uniformly and in thin layer by means of the elastic blade 74 as a developer layer thickness regulating member.

It is effective for the elastic coating blade to be brought into touch with the developer carrying member at a pressure of from 0.3 to 25 kg/m, and preferably from 0.5 to 12 kg/cm, as a linear pressure in the generatrix direction of the developer carrying member. If the touch pressure is smaller than 0.3 kg/m, it is difficult to uniformly coat the non-magnetic one-component developer, resulting in a broad charge quantity distribution of the non-magnetic one-component developer to cause fog or black spots around line images. If the touch pressure is greater than 25 kg/m, a great pressure is applied to the non-magnetic one-component developer to cause deterioration of the non-magnetic one-component developer and occurrence of agglomeration of the non-magnetic one-component developer, thus such a pressure is not preferable, and also not preferable because a great torque is required in order to drive the developer carrying member. That is, the adjustment of the touch pressure to 0.3 to 25 kg/m makes it possible to effectively loosen the agglomeration of non-magnetic one-component developer and makes it possible to effect instantaneous rise of the charge quantity of non-magnetic one-component developer.

As the elastic blade, usable are rubber elastic materials such as silicone rubber, urethane rubber and NBR, elastomers such as polyethylene terephthalate and polyamide, and metal elastic members such as stainless steel, steel and phosphor bronze. A composite of some of these may also be used. It may preferably be one comprising a metal sheet of SUS stainless steel or phosphor bronze having a springiness on which a rubber material such as urethane or silicone rubber or an elastomer of various type such as polyamide elastomer is provided by injection molding.

In this non-magnetic one-component development, in the system where the non-magnetic one-component developer is thin-layer coated on the developing sleeve by the blade, the thickness of the non-magnetic one-component developer on the developing sleeve may be made smaller than the gap a at which the developing sleeve and the latent image bearing member face and an alternating electric filed may be applied to this gap. This is preferable in order to obtain a sufficient image density. More specifically, a development bias formed of an alternating electric field or formed by superimposing a DC electric field on an alternating electric field may be applied across the developing sleeve 72 and the latent image bearing member 69 through a bias applying means shown in FIG. 1. This makes it easy for the non-magnetic one-component developer to move from the surface of the developing sleeve to the surface of the latent image bearing member, thus images with much better quality can be obtained.

In the present invention, the gap a between the latent image bearing member and the developer carrying member may preferably be set to be, e.g., from 50 to 500 $\mu$m, and the layer thickness of the developer layer carried on the developer carrying member, e.g., from 40 to 400 $\mu$m.

The developing sleeve is rotated at a peripheral speed of from 100 to 200% with respect to the latent image bearing member. The alternating electric field may preferably be applied at a peak-to-peak voltage of 0.1 kV or above, preferably from 0.2 to 3.0 kV, and more preferably from 0.3 to 2.0 kV. The alternating bias may be applied at a frequency of from 1.0 to 5.0 kHz, preferably from 1.0 to 3.0 kHz, and more preferably from 1.5 to 3.0 kHz. As the waveform of the alternating bias, rectangular waveform, sine waveform, saw-tooth waveform and triangle waveform can be used. An asymmetrical AC bias having different time for which forward/backward voltages are applied may also be used. It is also preferable to superimpose a DC bias.

The apparatus unit of the present invention will be described with reference to FIG. 1.

The apparatus unit of the present invention is mounted detachably to the body of the image forming apparatus (e.g., a copying machine, a laser beam printer or a facsimile machine).

In the embodiment shown in FIG. 1, the apparatus unit is the developing apparatus (assembly) 70, and the developing apparatus is mounted detachably to the body of the image forming apparatus.

Thus, the developing apparatus has the developer 76, the developing container 71, the developer carrying member 72, the feed roller 73, the developer layer thickness regulating member 74 and the agitating member 75. As the apparatus unit of the present invention, it may have at least the developer 76, the developing container 71 and the developer carrying member 72.

The apparatus unit may further have at least one member selected from the group consisting of the latent image bearing member, the cleaning member and the charging member together as one unit.

Figure 2:
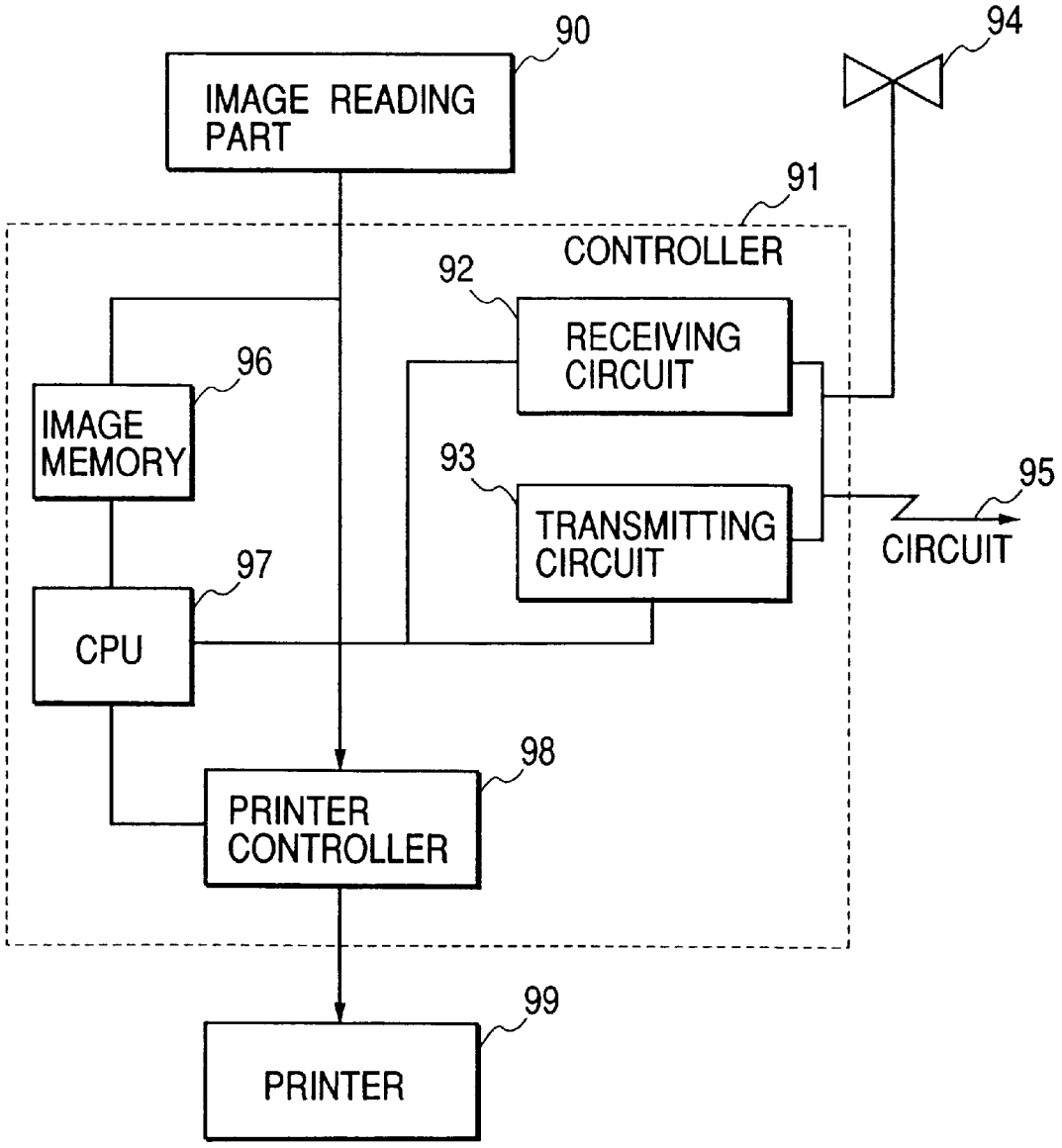
FIG. 2 is a block diagram of an instance where an image forming apparatus employing the image forming method of the present invention is applied in a printer of a facsimile system.

When the image forming method of the present invention is applied to a printer of a facsimile machine, the photoimagewise exposing light L serves as exposing light used for the printing of received data. FIG. 2 illustrates an example thereof in the form of a block diagram.

A controller 91 controls an image reading part 90 and a printer 99. The whole of the controller 91 is controlled by CPU 97. Image data outputted from the image reading part are sent to the other facsimile station through a transmitting circuit 93. Data received from the other station is sent to a printer 99 through a receiving circuit 92. Stated image data are stored in an image memory 96. A printer controller 98 controls the printer 99. The numeral 94 denotes a telephone.

Images received from a circuit 95 (image information from a remote terminal connected through the circuit) are demodulated in the receiving circuit 92, and then stored successively in an image memory 96 after the image information is decoded by the CPU 97. Then, once images for at least one page have been stored in the memory 96, the image recording for that page is performed. The CPU 97 reads out the image information for one page from the memory 96 and sends the coded image information for one page to the printer controller 98. The printer controller 98, having received the image information for one page from the CPU 97, controls the printer 99 so that the image information for one page is recorded.

The CPU 97 receives image information for next page in the course of the recording by the printer 99.

Images are received and recorded in the manner as described above.

As described above, according to the present invention, high-quality images can be formed without causing any increase in fog, faulty cleaning and lowering of transfer efficiency even in long-term service and also without causing any decrease in image density and any uneven images even in environment of low humidity.

EXAMPLES

The present invention will be described below in greater detail by giving Examples and Comparative Examples. In the following, "part(s)" refers to "part(s) by weight" in all occurrences.

Example 1

Into a four-necked flask having a high-speed stirrer TK-type homomixer, 710 parts of ion-exchanged water and 480 parts of an aqueous 0.1 mol/liter $Na_3PO_4$ solution were introduced, and the number of revolutions of the homomixer was adjusted to 14,000 rpm to carry out mixing. The mixture obtained was heated to 63° C. Then, 62 parts of an aqueous 1.0 mol/liter $CaCl_2$ solution was added thereto little by little to prepare an aqueous medium containing fine-particle slightly water-soluble dispersion stabilizer $Ca_3(PO_4)_2$.

Meanwhile, a disperse phase system was prepared.

| | |
|---|---|
| Styrene monomer | 165 parts |
| Butyl acrylate monomer | 35 parts |
| C.I. Pigment Blue 15:3 | 12 parts |
| Salicylic acid metal compound | 2 parts |

The above materials were dispersed for 3 hours by means of an attritor. Thereafter, to the mixture obtained, the following components were added, followed by further dispersion for 2 hours by means of the attritor, thus the disperse phase system was prepared.

| | |
|---|---|
| Saturated polyester (acid value: 12; peak molecular weight: 14,000) | 22 parts |
| Ester wax | 16 parts |

Next, the above disperse phase system was, after addition of 8 parts of a polymerization initiator 2,2'-azobis(2,4-dimethylvaleronitrile), introduced into the above aqueous dispersion medium to carry out granulation for 15 minutes at 14,000 rpm. Thereafter, the high-speed stirrer was changed for a stirrer having propeller stirring blades, and polymerization was carried out for 5 hours at 50 rpm. Then, its internal temperature was raised to 80° C., and polymerization was further carried out for 5 hours. After the polymerization was completed, the slurry formed was cooled, and diluted hydrochloric acid was added to dissolve away the dispersant, further followed by water washing, drying and classification to obtain toner particles with a weight-average particle diameter of 7.0 $\mu$m.

Next, to 100 parts of the toner particles thus obtained, i) 0.9 part of small-particle-diameter hydrophobic fine silica particles (silica A-1; BET specific surface area: 280 $m^2/g$; water-wettability: 78%; quantity of triboelectricity: −98 mC/kg) obtained by subjecting 100 parts of silica with a primary particle 50% particle diameter of about 7 nm to surface treatment with 14 parts of hexamethyldisilazane, ii) 0.4 part of large-particle-diameter hydrophobic fine silica particles (silica B-1; BET specific surface area: 31 $m^2/g$; water-wettability: 92%; quantity of triboelectricity: −83 mC/kg) obtained by subjecting 100 parts of silica with a primary particle 50% particle diameter of about 50 nm to surface treatment with 12 parts of dimethylsilicone oil (50 cSt at 25° C.) and iii) 0.3 part of fine alumina particles (alumina C-1; BET specific surface area: 85 $m^2/g$; water-wettability: 55%; quantity of triboelectricity: −28 mC/kg) obtained by subjecting 100 parts of alumina with a primary particle 50% particle diameter of about 15 nm to surface treatment with 10 parts of isobutyltrimethoxysilane were externally added by means of a Henschel mixer FM10B to obtain a toner. The toner thus obtained had an average circularity of 0.971.

Figure 4:
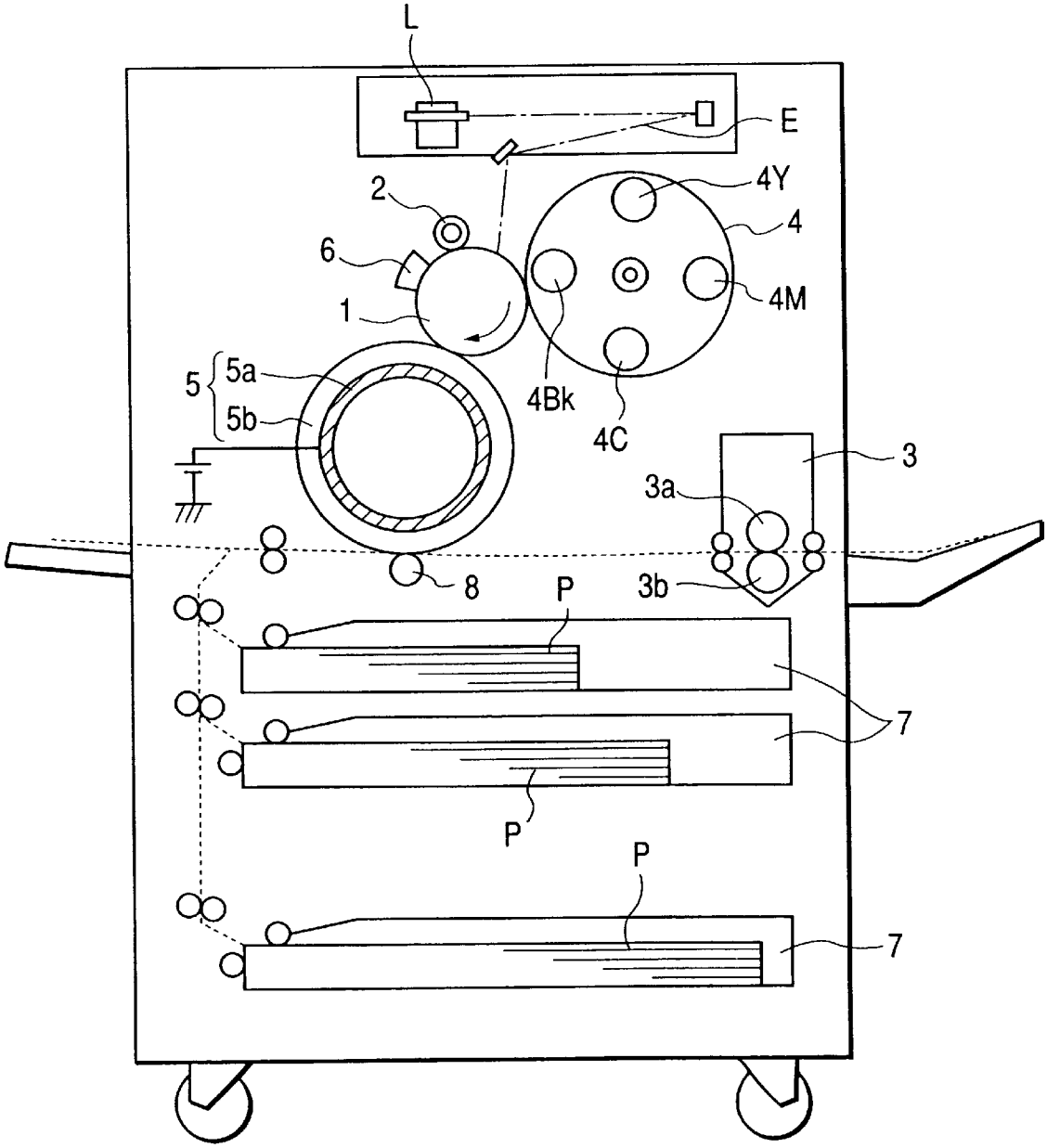
FIG. 4 illustrates an image forming apparatus that can carry out the image forming method making use of the toner of the present invention.

The toner obtained was used as one-component developer (1) and was put in a modified machine of a commercially available laser beam printer CANON LBP-2030, modified as shown in FIG. 4. Using it, evaluation was made by the method described later.

The modified machine of LBP-2030 is constituted as shown in FIG. 4. Using as the developing apparatus a rotary unit 4 in which the developing assembly 70 of the non-magnetic one-component developing system shown in FIG. 1, making use of the non-magnetic one-component developer, is mounted detachably as each of a black developing assembly 4Bk, a yellow developing assembly 4Y, a magenta developing assembly 4M and a cyan developing assembly 4C, a multiple toner image formed of the respective color toners having primarily been transferred onto an intermediate transfer drum 5 is secondarily one-time transferred to a recording medium P and thereafter heat-fixed to the recording medium P. Its fixing assembly 3 is also modified so as to be constituted in the following way.

As the fixing roller 3*a* of the fixing assembly 3, a roller comprising an aluminum core shaft covered with two types of layers is used. In a lower layer thereof, high-temperature vulcanized silicone rubber (HTV silicone rubber) is used as an elastic layer. The elastic layer is 2.1 mm thick and has a rubber hardness of 3° (JIS-A). In an upper layer, a tetrafluoroethylene-perfluoroalkyl vinyl ether copolymer (PFA) formed in a thin film by spray coating is used as a release layer. The thin film is 20 $\mu$m thick.

The pressure roller 3*b* of the fixing assembly 3 has, like the fixing roller 3*a*, a structure wherein a core shaft is covered with a lower-layer silicone rubber elastic layer and an upper-layer fluorine resin release layer, formed of the like materials and having the like thickness and like values of physical properties.

The nip width at the fixing zone is set to be 9.5 mm; the fixing pressure, $2.00\times10^5$ Pa; and the fixing roller surface temperature on standby, 180° C. The fixing oil coating mechanism is detached.

As the intermediate transfer drum 5, used is a drum comprising an aluminum cylinder the surface of which is covered with an elastic layer formed of a mixture of NBR and epichlorohydrin in a thickness of 5 mm.

The cyan developing assembly 4C of the above modified machine of LBP-2030 was supplied with 160 g of the above non-magnetic one-component developer (1). As the recording medium P, commercially available copy sheets CLC Paper A4 (available from CANON SALES INC.; basis weight: 81.4 g/m$^2$) were set in the tray 7, and continuous running tests were made under conditions shown below.

Primary Charging Conditions:

From a power source (not shown), charging bias voltage formed by superimposing a DC voltage of −600 V and an AC voltage of 1,150 Hz sinusoidal wave in an amplitude of 2 kVpp was applied to the charging roller 2 to charge the insulating material photosensitive drum 1 uniformly while making electric charges move by discharging.

Latent Image Formation Conditions:

The surface of the photosensitive drum 1 charged uniformly was irradiated by laser light L to make exposure to form electrostatic latent images. The intensity of laser light was so set as to provide a surface potential of −150 V at the exposed areas.

Development Conditions:

To the developing sleeve of the cyan developing assembly 4C shown in FIG. 4, development bias voltage formed by superimposing a DC voltage of −350 V and an AC voltage of 2,250 Hz sinusoidal wave in an amplitude of 1.8 kVpp was applied to form an alternating electric field at the gap between the developing sleeve and the photosensitive drum 1, where the toner on the developing sleeve was made to fly to the photosensitive drum 1 to perform development.

Primary Transfer Conditions:

In order to primarily transfer to the intermediate transfer drum 5 the toner image formed on the photosensitive drum 1 by the developing assembly 4C, a DC voltage of +300 V was applied to the aluminum drum 5*a* as the primary transfer bias voltage.

Secondary Transfer Conditions:

In order to secondarily transfer to the recording medium P the toner image primarily transferred onto the intermediate transfer drum 5, a DC voltage of +1,950 V was applied to the transfer means 8 as the secondary transfer bias voltage.

Evaluation (1) Image Density

In environment of 30° C./80%RH and 15° C./5%RH each, a pattern with an image percentage of 6% (A4) is continuously printed. A solid black pattern is printed on the 50th sheet, 2,000th sheet and 5,000th sheet, and the density at areas of 3 cm from the paper ends is measured (three-point average at the middle and the both ends). The density is measured with a reflection densitometer RD918 (manufactured by Macbeth Co.).

(2) Uneven Images

In environment of 30° C./80%RH and 15° C./5%RH each, a pattern with an image percentage of 6% (A4) is continuously printed. A solid black pattern is continuously printed on 10 sheets at the 50th sheet, 2,000th sheet and 5,000th sheet printing, and the density at areas of 3 cm and at areas of 15 cm from the paper ends of the 10th sheet are measured (three-point average at the middle and the both ends) by reflectometer RD918. Density difference at these two points is examined to make evaluation on uneven images.

(3) Fog Density

In environment of 30° C./80%RH and 15° C./5%RH each, a pattern with an image percentage of 6% (A4) is continuously printed. A pattern with an image percentage of 2% is continuously printed on 50 sheets at the 50th sheet, 2,000th sheet and 5,000th sheet printing, and thereafter a solid white pattern is printed on 1 sheet. The reflectance of this print and that of virgin paper are measured, and the difference between them is regarded as fog density.

The results of evaluation are shown in Table 1.

Example 2

| | |
|---|---|
| Polyester resin | 100 parts |
| Carbon black | 7 parts |
| Low-molecular weight polyethylene | 3 parts |
| Di-t-butylsalicylic acid chromium complex | 4 parts |

The above materials were mixed using a Henschel mixer, and the mixture obtained was melt-kneaded by means of a twin-screw extrusion kneader. Thereafter, the kneaded product obtained was crushed using a hammer mill, and the crushed product was finely pulverized by means of a jet mill, followed by classification to obtain toner particles with a weight-average particle diameter of 8.8 $\mu$m.

Next, to 100 parts of the toner particles thus obtained, i) 1.2 parts of small-particle-diameter hydrophobic fine silica particles (silica A-2; BET specific surface area: 125 m$^2$/g; water-wettability: 93%; quantity of triboelectricity: −115 mC/kg) obtained by subjecting 100 parts of silica with a primary particle 50% particle diameter of about 12 nm to surface treatment with 11 parts of isobutyltrimethoxysilane, ii) 0.5 part of large-particle-diameter hydrophobic fine silica particles (silica B-2; BET specific surface area: 75 m$^2$/g; water-wettability: 90%; quantity of triboelectricity: −95 mC/kg) obtained by subjecting 100 parts of silica with a primary particle 50% particle diameter of about 30 nm to surface treatment with 15 parts of dimethylsilicone oil (50 cSt at 25° C.) and iii) 0.5 part of fine alumina particles (alumina C-2; BET specific surface area: 60 m$^2$/g; water-wettability: 70%; quantity of triboelectricity: −17 mC/kg) obtained by subjecting 100 parts of alumina with a primary particle 50% particle diameter of about 20 nm to surface treatment with 15 parts of isobutyltrimethoxysilane were externally added by means of a Henschel mixer FM10B to obtain a toner. The toner thus obtained had an average circularity of 0.938. The toner obtained was evaluated in the same manner as in Example 1.

The results of evaluation are shown in Table 1.

Example 3

| | |
|---|---|
| Styrene acrylic resin | 100 parts |
| Carbon black | 10 parts |
| Low-molecular weight polypropylene | 4 parts |
| Di-t-butylsalicylic acid chromium complex | 4 parts |

The above materials were mixed using a Henschel mixer, and the mixture obtained was melt-kneaded by means of a twin-screw extrusion kneader. Thereafter, the kneaded product obtained was crushed using a hammer mill, and the crushed product was finely pulverized by means of Criptron (manufactured by Kawasaki Heavy Industries, Ltd.), followed by classification to obtain toner particles with a weight-average particle diameter of 6.0 $\mu$m.

Next, to 100 parts of the toner particles thus obtained, i) 1.3 parts of small-particle-diameter hydrophobic fine silica particles (silica A-3; BET specific surface area: 160 $m^2/g$; water-wettability: 82%; quantity of triboelectricity: −107 mC/kg) obtained by subjecting 100 parts of silica with a primary particle 50% particle diameter of about 10 nm to surface treatment with 13 parts of hexamethyldisilazane, ii) 0.4 part of large-particle-diameter hydrophobic fine silica particles (silica B-3; BET specific surface area: 55 $m^2/g$; water-wettability: 88%; quantity of triboelectricity: −98 mC/kg) obtained by subjecting 100 parts of silica with a primary particle 50% particle diameter of about 40 nm to surface treatment with 13 parts of dimethylsilicone oil (50 cSt at 25° C.) and iii) 0.1 part of fine alumina particles (alumina C-3; BET specific surface area: 100 $m^2/g$; water-wettability: 21%; quantity of triboelectricity: −5.3 mC/kg) were externally added by means of a Henschel mixer FM10B to obtain a toner. The toner thus obtained had an average circularity of 0.946. The toner obtained was evaluated in the same manner as in Example 1.

The results of evaluation are shown in Table 1.

Examples 4 to 6

Magenta toner particles with a weight-average particle diameter of 6.5 $\mu$m, yellow toner particles with a weight-average particle diameter of 7.2 $\mu$m and black toner particles with a weight-average particle diameter of 5.5 $\mu$m were obtained in the same manner as in Example 1 except that the C.I. Pigment Blue 15:3 used therein was replaced with 14 parts of C.I. Pigment Red 122, 10 parts of C.I. Pigment Yellow 17 and 12 parts of carbon black, respectively.

Next, to 100 parts of each color toner particles thus obtained, i) 1.0 part the silica A-3 used in Example 1, ii) 0.2 part of large-particle-diameter hydrophobic fine silica particles (silica B-4; BET specific surface area: 43 $m^2/g$; water-wettability: 85%; quantity of triboelectricity: −71 mC/kg) obtained by subjecting 100 parts of silica with a primary particle 50% particle diameter of about 45 nm to surface treatment with 10 parts of dimethylsilicone oil (50 cSt at 25° C.) and iii) 0.08 part of fine alumina particles (alumina C-4; BET specific surface area: 145 $m^2/g$; water-wettability: 10%; quantity of triboelectricity: −7.8 mC/kg) were externally added by means of a Henschel mixer FM10B to obtain a magenta toner (Example 4), a yellow toner (Example 5) and a black toner (Example 6), respectively. The toners obtained had an average circularity of 0.978, 0.962 and 0.983 in respect of the magenta toner, yellow toner and black toner, respectively. The toners thus obtained were evaluated in the same manner as in Example 1.

The results of evaluation are shown in Table 1.

Example 7

A toner was obtained in the same manner as in Example 1 except that the alumina C-1 used in Example 1 was replaced with 0.3 part of the alumina C-4 used in Examples 4 to 6. The toner obtained was evaluated in the same manner as in Example 1.

The results of evaluation are shown in Table 1.

Example 8

The toner particles used in Example 2 were subjected to spherical treatment for 2 hours under conditions of a treatment temperature of 55° C. and an agitating blade peripheral speed of 50 m/sec using Hybridizer (manufactured by Nara Kikai Seisakusho), to obtain toner particles with a weight-average particle diameter of 8.6 $\mu$m.

To the toner particles thus obtained, the silica A-2, silica B-2 and alumina C-2 were externally added in the same manner as in Example 2 to obtain a toner. The toner thus obtained had an average circularity of 0.955. The toner obtained was evaluated in the same manner as in Example 1.

The results of evaluation are shown in Table 1.

Comparative Example 1

To 100 parts of the toner particles used in Example 1, i) 1.3 parts of hydrophobic fine silica particles with a primary particle 50% particle diameter of about 12 nm (R974; available from Nippon Aerosil Co., Ltd.; treated with dimethyldichlorosilane; BET specific surface area: 183 $m^2/g$; water-wettability: 43%; quantity of triboelectricity: −73 mC/kg), ii) 0.4 part of hydrophobic fine silica particles with a primary particle 50% particle diameter of about 16 nm (R972; available from Nippon Aerosil Co., Ltd.; treated with dimethyldichlorosilane; BET specific surface area: 115 $m^2/g$; water-wettability: 45%; quantity of triboelectricity: −65 mC/kg) and iii) 0.1 part of hydrophobic fine alumina particles with a primary particle 50% particle diameter of about 15 nm (RFY-C; available from Nippon Aerosil Co., Ltd.; BET specific surface area: 80 $m^2/g$; water-wettability: 34%; quantity of triboelectricity: −12 mC/kg) were externally added by means of a Henschel mixer FM10B to obtain a toner. The toner thus obtained had an average circularity of 0.971. The toner obtained was evaluated in the same manner as in Example 1.

The results of evaluation are shown in Table 1.

Comparative Example 2

To 100 parts of the toner particles used in Example 1, 1.1 part and 0.5 part of the silica A-1 and silica B-1, respectively, used in Example 1 were externally added without use of the alumina C-1 by means of a Henschel mixer FM10B to obtain a toner. The toner thus obtained had an average circularity of 0.971. The toner obtained was evaluated in the same manner as in Example 1.

The results of evaluation are shown in Table 1.

Comparative Example 3

A toner was obtained in the same manner as in Example 3 except that, to 100 parts of the toner particles used therein, 0.2 part of fine alumina particles (alumina C-5; BET specific surface area: 230 $m^2/g$; water-wettability: 5%; quantity of triboelectricity: −33 mC/kg) were added in place of the alumina C-3. The toner thus obtained had an average circularity of 0.946. The toner obtained was evaluated in the same manner as in Example 1.

The results of evaluation are shown in Table 1.

Comparative Example 4

A toner was obtained in the same manner as in Comparative Example 1 except that the hydrophobic silica R-972 used therein was replaced with 0.4 part of hydrophobic fine silica particles (silica B-5; BET specific surface area: 95 $m^2/g$; water-wettability: 65%; quantity of triboelectricity: −92 mC/kg) obtained by subjecting 100 parts of silica with a primary particle 50% particle diameter of about 19 nm to surface treatment with 8 parts of dimethylsilicone oil (50 cSt at 25° C.). The toner thus obtained had an average circularity of 0.971. The toner obtained was evaluated in the same manner as in Example 1.

The results of evaluation are shown in Table 1.

Comparative Example 5

To 100 parts of the toner particles used in Example 1, 0.9 part and 0.7 part of the silica B-1 and alumina C-1, respectively, used in Example 1 were externally added without use of the silica A-1 by means of a Henschel mixer FM10B to obtain a toner. The toner thus obtained had an average circularity of 0.971. The toner obtained was evaluated in the same manner as in Example 1.

The results of evaluation are shown in Table 1.

Comparative Example 6

To 100 parts of the toner particles used in Example 1, 1.2 parts and 0.4 part of the silica A-1 and alumina C-1, respectively, used in Example 1 were externally added without use of the silica B-1 by means of a Henschel mixer FM10B to obtain a toner. The toner thus obtained had an average circularity of 0.971. The toner obtained was evaluated in the same manner as in Example 1.

The results of evaluation are shown in Table 1.

Comparative Example 7

A toner was obtained in the same manner as in Example 3 except that the silica B-3 used therein was replaced with 0.4 part of hydrophobic fine silica particles (silica B-6; BET specific surface area: 13 $m^2/g$; water-wettability: 63%; quantity of triboelectricity: −48 mC/kg) obtained by subjecting 100 parts of silica with a primary particle 50% particle diameter of about 160 nm to surface treatment with 5 parts of dimethylsilicone oil (50 cSt at 25° C.). The toner thus obtained had an average circularity of 0.946. The toner obtained was evaluated in the same manner as in Example 1.

The results of evaluation are shown in Table 1.

Comparative Example 8

A toner was obtained in the same manner as in Example 3 except that the silica A-3 used therein was replaced with 1.3 parts of hydrophobic fine silica particles (silica A-4; BET specific surface area: 86 $m^2/g$; water-wettability: 75%; quantity of triboelectricity: −70 mC/kg) obtained by subjecting 100 parts of silica with a primary particle 50% particle diameter of about 23 nm to surface treatment with 7 parts of hexamethyldisilazane. The toner thus obtained had an average circularity of 0.946. The toner obtained was evaluated in the same manner as in Example 1. The results of evaluation are shown in Table 1.

TABLE 1

| | | Evaluation Results | | | | | | | | | |
|---|---|---|---|---|---|---|---|---|---|---|---|
| | | Image density | | | Uneven images | | | Fog density | | | |
| | | 50th sheet | 2,000th sheet | 5,000th sheet | 50th sheet | 2,000th sheet | 5,000th sheet | 50th sheet | 2,000th sheet | 5,000th sheet | Remarks |
| Example: | | | | | | | | | | | |
| 1 | 30° C./80% RH | 1.45 | 1.40 | 1.37 | 0.02 | 0.02 | 0.03 | 0.2 | 0.3 | 0.5 | |
| | 15° C./5% RH | 1.44 | 1.40 | 1.35 | 0.02 | 0.03 | 0.05 | 0.2 | 0.2 | 0.3 | |
| 2 | 30° C./80% RH | 1.45 | 1.39 | 1.36 | 0.02 | 0.05 | 0.09 | 0.2 | 0.4 | 0.7 | |
| | 15° C./5% RH | 1.45 | 1.38 | 1.35 | 0.02 | 0.07 | 0.12 | 0.2 | 0.3 | 0.5 | |
| 3 | 30° C./80% RH | 1.45 | 1.42 | 1.41 | 0.02 | 0.04 | 0.07 | 0.2 | 0.3 | 0.5 | |
| | 15° C./5% RH | 1.45 | 1.43 | 1.43 | 0.02 | 0.06 | 0.08 | 0.2 | 0.3 | 0.4 | |
| 4 | 30° C./80% RH | 1.46 | 1.45 | 1.43 | 0.02 | 0.02 | 0.03 | 0.2 | 0.2 | 0.3 | |
| | 15° C./5% RH | 1.46 | 1.44 | 1.44 | 0.02 | 0.02 | 0.03 | 0.2 | 0.2 | 0.2 | |
| 5 | 30° C./80% RH | 1.45 | 1.44 | 1.43 | 0.02 | 0.02 | 0.03 | 0.1 | 0.3 | 0.3 | |
| | 15° C./5% RH | 1.45 | 1.44 | 1.42 | 0.02 | 0.02 | 0.03 | 0.1 | 0.2 | 0.2 | |
| 6 | 30° C./80% RH | 1.48 | 1.44 | 1.42 | 0.02 | 0.02 | 0.03 | 0.2 | 0.2 | 0.2 | |
| | 15° C./5% RH | 1.48 | 1.45 | 1.45 | 0.02 | 0.02 | 0.02 | 0.2 | 0.2 | 0.2 | |
| 7 | 30° C./80% RH | 1.45 | 1.45 | 1.44 | 0.02 | 0.02 | 0.03 | 0.2 | 0.2 | 0.2 | |
| | 15° C./5% RH | 1.45 | 1.43 | 1.43 | 0.02 | 0.02 | 0.03 | 0.2 | 0.2 | 0.3 | |
| 8 | 30° C./80% RH | 1.45 | 1.40 | 1.40 | 0.02 | 0.04 | 0.08 | 0.2 | 0.3 | 0.6 | |
| | 15° C./5% RH | 1.45 | 1.42 | 1.40 | 0.02 | 0.06 | 0.09 | 0.2 | 0.3 | 0.4 | |
| Comparative Example: | | | | | | | | | | | |
| 1 | 30° C./80% RH | 1.46 | 1.36 | 1.28 | 0.02 | 0.10 | 0.15 | 0.3 | 0.7 | 1.3 | *1 |
| | 15° C./5% RH | 1.46 | 1.37 | 1.30 | 0.02 | 0.10 | 0.13 | 0.3 | 0.9 | 1.5 | |
| 2 | 30° C./80% RH | 1.46 | 1.35 | 1.24 | 0.10 | 0.13 | 0.25 | 0.3 | 0.9 | 1.5 | |
| | 15° C./5% RH | 1.46 | 1.35 | 1.19 | 0.80 | 0.11 | 0.20 | 0.3 | 1.1 | 1.8 | |
| 3 | 30° C./80% RH | 1.46 | 1.37 | 1.30 | 0.02 | 0.09 | 0.15 | 0.3 | 0.8 | 1.3 | |
| | 15° C./5% RH | 1.46 | 1.38 | 1.31 | 0.02 | 0.08 | 0.14 | 0.3 | 0.6 | 1.1 | |
| 4 | 30° C./80% RH | 1.46 | 1.38 | 1.31 | 0.02 | 0.07 | 0.11 | 0.2 | 0.5 | 0.9 | |
| | 15° C./5% RH | 1.46 | 1.38 | 1.32 | 0.02 | 0.06 | 0.10 | 0.2 | 0.7 | 1.2 | |
| 5 | 30° C./80% RH | 1.29 | 1.25 | 1.22 | 0.09 | 0.11 | 0.14 | 0.3 | 0.9 | 1.3 | |
| | 15° C./5% RH | 1.30 | 1.24 | 1.23 | 0.13 | 0.15 | 0.15 | 0.3 | 0.8 | 1.2 | |
| 6 | 30° C./80% RH | 1.45 | 1.35 | 1.22 | 0.02 | 0.08 | 0.09 | 0.3 | 0.9 | 1.7 | |
| | 15° C./5% RH | 1.44 | 1.36 | 1.24 | 0.02 | 0.09 | 0.11 | 0.3 | 1.2 | 1.9 | |
| 7 | 30° C./80% RH | 1.44 | 1.39 | 1.37 | 0.02 | 0.05 | 0.09 | 0.3 | 0.4 | 0.7 | |

TABLE 1-continued

| | Evaluation Results | | | | | | | | | |
|---|---|---|---|---|---|---|---|---|---|---|
| | Image density | | | Uneven images | | | Fog density | | | |
| | 50th sheet | 2,000th sheet | 5,000th sheet | 50th sheet | 2,000th sheet | 5,000th sheet | 50th sheet | 2,000th sheet | 5,000th sheet | Remarks |
| 15° C./5% RH | 1.45 | 1.38 | 1.35 | 0.02 | 0.06 | 0.10 | 0.3 | 0.5 | 0.5 | *2 |
| 8 30° C./80% RH | 1.39 | 1.33 | 1.28 | 0.05 | 0.09 | 0.11 | 0.3 | 0.5 | 0.8 | |
| 15° C./5% RH | 1.38 | 1.34 | 1.27 | 0.07 | 0.08 | 0.11 | 0.3 | 0.7 | 0.9 | |

*1: Faulty cleaning occurred.
*2: Photosensitive member filming occurred.

Example 9

160 g each of the cyan toner produced in Example 1, the magenta toner produced in Example 4, the yellow toner produced in Example 5 and the black toner used in Example 6 were put in the cyan developing assembly 4C, the magenta developing assembly 4M, the yellow developing assembly 4Y and the black developing assembly 4Bk, preferably, of the modified machine of LBP-2030 used in Example 1, in which the developing assembly 70 of the non-magnetic one-component developing system shown in FIG. 1 was mounted detachably as each of the black developing assembly 4Bk, the yellow developing assembly 4Y, the magenta developing assembly 4M and the cyan developing assembly 4C. As the recording paper P, commercially available CLC paper-A4 was set in the tray 7, and full-color images were formed. As a result, sharp images having a sufficiently high image density and a superior gradation were obtained without causing any faulty transfer, fog, faulty cleaning and toner spots around line images.

What is claimed is:

1. A toner comprising toner particles and an external additive, wherein;

said toner particles have a weight-average particle diameter of from 4 $\mu$m to 9 $\mu$m; and said external additive has (i) first, small-particle-diameter hydrophobic fine silica particles (A) having a BET specific surface area of from 100 $m^2/g$ to 350 $m^2/g$, having been treated with a silane, (ii) second, large-particle-diameter hydrophobic fine silica particles (B) having a BET specific surface area of from 15 $m^2/g$ to 80 $m^2/g$, having been treated with a silicone oil, and (iii) fine alumina particles (C) having a BET specific surface area of from 50 $m^2/g$ to 150 $m^2/g$.

2. The toner according to claim 1, wherein said small-particle-diameter hydrophobic fine silica particles (A) have a primary particle 50% particle diameter of from 5 nm to 20 nm, and said large-particle-diameter hydrophobic fine silica particles (B) have a primary particle 50% particle diameter of from 30 nm to 150 nm.

3. The toner according to claim 1, wherein said small-particle-diameter hydrophobic fine silica particles (A) have a BET specific surface area of from 150 $m^2/g$ to 300 $m^2/g$.

4. The toner according to claim 1, wherein said small-particle-diameter hydrophobic fine silica particles (A) have a quantity of triboelectricity of from −40 mC/kg to −150 mC/kg.

5. The toner according to claim 1, wherein the silane used to treat said small-particle-diameter hydrophobic fine silica particles (A) is a treating agent selected from the group consisting of an alkoxysilane, a silazane and a chlorosilane.

6. The toner according to claim 1, wherein the silane used to treat said small-particle-diameter hydrophobic fine silica particles (A) is a disilazane.

7. The toner according to claim 1, wherein said small-particle-diameter hydrophobic fine silica particles (A) have been treated with the silane in an amount of from 5 parts by weight to 25 parts by weight based on 100 parts by weight of the fine silica particles.

8. The toner according to claim 1, wherein said small-particle-diameter hydrophobic fine silica particles (A) have a water-wettability of 70% or above.

9. The toner according to claim 1, wherein said large-particle-diameter hydrophobic fine silica particles (B) have a BET specific surface area of from 20 $m^2/g$ to 60 $m^2/g$.

10. The toner according to claim 1, wherein said large-particle-diameter hydrophobic fine silica particles (B) have a quantity of triboelectricity of from −60 mC/kg to −100 mC/kg.

11. The toner according to claim 1, wherein the silicone oil used to treat said large-particle-diameter hydrophobic fine silica particles (B) is a treating agent selected from the group consisting of dimethylsilicone oil, methylphenylsilicone oil and methylhydrogensilicone oil.

12. The toner according to claim 1, wherein the silicone oil used to treat said large-particle-diameter hydrophobic fine silica particles (B) has a viscosity of 100 cSt or below at 25° C.

13. The toner according to claim 1, wherein said large-particle-diameter hydrophobic fine silica particles (B) have been treated with the silicone oil in an amount of from 2 parts by weight to 20 parts by weight based on 100 parts by weight of the fine silica particles.

14. The toner according to claim 1, wherein said large-particle-diameter hydrophobic fine silica particles (B) have a water-wettability of 80% or above.

15. The toner according to claim 1, wherein said fine alumina particles (C) have a quantity of triboelectricity of from +30 mC/kg to −20 mC/kg.

16. The toner according to claim 1, wherein said fine alumina particles (C) have a water-wettability of 30% or below.

17. The toner according to claim 1, wherein said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles, and said fine alumina particles (C) are added to the toner in an amount (c) of from 0.01 part by weight to 2.0 parts by weight based on 100 parts by weight of the toner particles.

18. The toner according to claim 17, wherein said small-particle-diameter hydrophobic fine silica particles (A), large-particle-diameter hydrophobic fine silica particles (B) and fine alumina particles (C) are added in amount (a), amount (b) and amount (c), respectively, in the ratio satisfying the following relationship:

a:b:c=1:0.10 to 0.65:0.05 to 0.50.

19. The toner according to claim 1, wherein said fine alumina particles (C) have a water-wettability more than 30%, and said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles and the fine alumina particles (C) having a water-wettability more than 30% are added to the toner in an amount (c1) of from 0.05 part by weight to 2.0 parts by weight based on 100 parts by weight of the toner particles.

20. The toner according to claim 19, wherein said small-particle-diameter hydrophobic fine silica particles (A), large-particle-diameter hydrophobic fine silica particles (B) and fine alumina particles (C) having a water-wettability more than 30% are added in amount (a), amount (b) and amount (c1), respectively, in the ratio satisfying the following relationship:

a:b:c1=1:0.10 to 0.65:0.20 to 0.50.

21. The toner according to claim 1, wherein said fine alumina particles (C) have a water-wettability not more than 30%, and said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles and the fine alumina particles (C) having a water-wettability not more than 30% are added to the toner in an amount (c2) of from 0.01 part by weight to 1.0 part by weight based on 100 parts by weight of the toner particles.

22. The toner according to claim 21, wherein said small-particle-diameter hydrophobic fine silica particles (A), large-particle-diameter hydrophobic fine silica particles (B) and fine alumina particles (C) having a water-wettability not more than 30% are added in amount (a), amount (b) and amount (c2), respectively, in the ratio satisfying the following relationship:

a:b:c2=1:0.10 to 0.65:0.05 to 0.35.

23. The toner according to claim 1, which has an average circularity of from 0.950 to 1.000.

24. The toner according to claim 1, which has an average circularity of from 0.950 to 0.990.

25. The toner according to claim 1, which has an average circularity of from 0.960 to 0.985.

26. The toner according to claim 1, wherein said toner particles are toner particles produced by a suspension polymerization process in which a polymerizable monomer composition is polymerized in an aqueous medium.

27. The toner according to claim 1, wherein said toner particles are toner particles produced by a mechanical pulverization process having the steps of melt-kneading a toner material having a binder resin and mechanically pulverizing the resultant kneaded product.

28. The toner according to claim 1, wherein said toner particles have been subjected to spherical treatment.

29. The toner according to claim 1, which is produced by mixing said toner particles, said small-particle-diameter hydrophobic fine silica particles (A), said large-particle-diameter hydrophobic fine silica particles (B) and said fine alumina particles (C) by means of a mixing machine.

30. A toner comprising toner particles and an external additive, wherein;

said toner particles have a weight-average particle diameter of from 4 $\mu$m to 9 $\mu$m; and said external additive has (i) first, small-particle-diameter hydrophobic fine silica particles (A) having a primary particle 50% particle diameter of from 5 nm to 20 nm, having been treated with a silane, (ii) second, large-particle-diameter hydrophobic fine silica particles (B) having a primary particle 50% particle diameter of from 30 nm to 150 nm, having been treated with a silicone oil, and (iii) fine alumina particles (C) having a BET specific surface area of from 50 $m^2/g$ to 150 $m^2/g$.

31. The toner according to claim 30, wherein said small-particle-diameter hydrophobic fine silica particles (A) have a BET specific surface area of from 100 $m^2/g$ to 350 $m^2/g$, and said large-particle-diameter hydrophobic fine silica particles (B) have a BET specific surface area of from 15 $m^2/g$ to 80 $m^2/g$.

32. The toner according to claim 30, wherein said small-particle-diameter hydrophobic fine silica particles (A) have a BET specific surface area of from 150 $m^2/g$ to 300 $m^2/g$.

33. The toner according to claim 30, wherein said small-particle-diameter hydrophobic fine silica particles (A) have a quantity of triboelectricity of from −40 mC/kg to −150 mC/kg.

34. The toner according to claim 30, wherein the silane used to treat said small-particle-diameter hydrophobic fine silica particles (A) is a treating agent selected from the group consisting of an alkoxysilane, a silazane and a chlorosilane.

35. The toner according to claim 30, wherein the silane used to treat said small-particle-diameter hydrophobic fine silica particles (A) is a disilazane.

36. The toner according to claim 30, wherein said small-particle-diameter hydrophobic fine silica particles (A) have been treated with the silane in an amount of from 5 parts by weight to 25 parts by weight based on 100 parts by weight of the fine silica particles.

37. The toner according to claim 30, wherein said small-particle-diameter hydrophobic fine silica particles (A) have a water-wettability of 70% or above.

38. The toner according to claim 30, wherein said large-particle-diameter hydrophobic fine silica particles (B) have a BET specific surface area of from 20 $m^2/g$ to 60 $m^2/g$.

39. The toner according to claim 30, wherein said large-particle-diameter hydrophobic fine silica particles (B) have a quantity of triboelectricity of from −60 mC/kg to −100 mC/kg.

40. The toner according to claim 30, wherein the silicone oil used to treat said large-particle-diameter hydrophobic fine silica particles (B) is a treating agent selected from the group consisting of dimethylsilicone oil, methylphenylsilicone oil and methylhydrogensilicone oil.

41. The toner according to claim 30, wherein the silicone oil used to treat said large-particle-diameter hydrophobic fine silica particles (B) has a viscosity of 100 cSt or below at 25° C.

42. The toner according to claim 30, wherein said large-particle-diameter hydrophobic fine silica particles (B) have been treated with the silicone oil in an amount of from 2 parts by weight to 20 parts by weight based on 100 parts by weight of the fine silica particles.

43. The toner according to claim 30, wherein said large-particle-diameter hydrophobic fine silica particles (B) have a water-wettability of 80% or above.

44. The toner according to claim 30, wherein said fine alumina particles (C) have a quantity of triboelectricity of from +30 mC/kg to −20 mC/kg.

45. The toner according to claim 31, wherein said fine alumina particles (C) have a water-wettability of 30% or below.

46. The toner according to claim 30, wherein said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles, and said fine alumina particles (C) are added to the toner in an amount (c) of from 0.01 part by weight to 2.0 parts by weight based on 100 parts by weight of the toner particles.

47. The toner according to claim 46, wherein said small-particle-diameter hydrophobic fine silica particles (A), large-particle-diameter hydrophobic fine silica particles (B) and fine alumina particles (C) are added in amount (a), amount (b) and amount (c), respectively, in the ratio satisfying the following relationship:

a:b:c=1:0.10 to 0.65:0.05 to 0.50.

48. The toner according to claim 30, wherein said fine alumina particles (C) have a water-wettability more than 30%, and said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles and the fine alumina particles (C) having a water-wettability more than 30% are added to the toner in an amount (c1) of from 0.05 part by weight to 2.0 parts by weight based on 100 parts by weight of the toner particles.

49. The toner according to claim 48, wherein said small-particle-diameter hydrophobic fine silica particles (A), large-particle-diameter hydrophobic fine silica particles (B) and fine alumina particles (C) having a water-wettability more than 30% are added in amount (a), amount (b) and amount (c1), respectively, in the ratio satisfying the following relationship:

a:b:c1=1:0.10 to 0.65:0.20 to 0.50.

50. The toner according to claim 30, wherein said fine alumina particles (C) have a water-wettability not more than 30%, and said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles and the fine alumina particles (C) having a water-wettability not more than 30% are added to the toner in an amount (c2) of from 0.01 part by weight to 1.0 part by weight based on 100 parts by weight of the toner particles.

51. The toner according to claim 50, wherein said small-particle-diameter hydrophobic fine silica particles (A), large-particle-diameter hydrophobic fine silica particles (B) and fine alumina particles (C) having a water-wettability not more than 30% are added in amount (a), amount (b) and amount (c2), respectively, in the ratio satisfying the following relationship:

a:b:c2=1:0.10 to 0.65:0.05 to 0.35.

52. The toner according to claim 30, which has an average circularity of from 0.950 to 1.000.

53. The toner according to claim 30, which has an average circularity of from 0.950 to 0.990.

54. The toner according to claim 31, which has an average circularity of from 0.960 to 0.985.

55. The toner according to claim 30, wherein said toner particles are toner particles produced by a suspension polymerization process in which a polymerizable monomer composition is polymerized in an aqueous medium.

56. The toner according to claim 30, wherein said toner particles are toner particles produced by a mechanical pulverization process having the steps of melt-kneading a toner material having a binder resin and mechanically pulverizing the resultant kneaded product.

57. The toner according to claim 30, wherein said toner particles have been subjected to spherical treatment.

58. The toner according to claim 30, which is produced by mixing said toner particles, said small-particle-diameter hydrophobic fine silica particles (A), said large-particle-diameter hydrophobic fine silica particles (B) and said fine alumina particles (C) by means of a mixing machine.

59. An image forming method comprising;

an electrostatic latent image forming step of forming an electrostatic latent image on a latent image bearing member; and a developing step of developing with a toner the electrostatic latent image formed on the latent image bearing member;

wherein;

in the developing step, said toner is fed onto a developer carrying member by means of a developer feed roller brought into contact with the developer carrying member, the layer thickness of said toner is regulated by means of a developer layer thickness regulating member brought into touch with the surface of the developer carrying member, and the electrostatic latent image is developed with the toner of a layer-thickness-regulated toner layer, carried on the developer carrying member; and said toner has toner particles and an external additive;

said toner particles having a weight-average particle diameter of from 4 $\mu$m to 9 $\mu$m; and said external additive having (i) first, small-particle-diameter hydrophobic fine silica particles (A) having a BET specific surface area of from 100 $m^2/g$ to 350 $m^2/g$, having been treated with a silane, (ii) second, large-particle-diameter hydrophobic fine silica particles (B) having a BET specific surface area of from 15 $m^2/g$ to 80 $m^2/g$, having been treated with a silicone oil, and (iii) fine alumina particles (C) having a BET specific surface area of from 50 $m^2/g$ to 150 $m^2/g$.

60. The method according to claim 59, wherein said small-particle-diameter hydrophobic fine silica particles (A) have a primary particle 50% particle diameter of from 5 nm to 20 nm, and said large-particle-diameter hydrophobic fine silica particles (B) have a primary particle 50% particle diameter of from 30 nm to 150 nm.

61. The method according to claim 59, wherein said small-particle-diameter hydrophobic fine silica particles (A) have a BET specific surface area of from 150 $m^2/g$ to 300 $m^2/g$.

62. The method according to claim 59, wherein said small-particle-diameter hydrophobic fine silica particles (A) have a quantity of triboelectricity of from −40 mC/kg to −150 mC/kg.

63. The method according to claim 59, wherein the silane used to treat said small-particle-diameter hydrophobic fine silica particles (A) is a treating agent selected from the group consisting of an alkoxysilane, a silazane and a chlorosilane.

64. The method according to claim 59, wherein the silane used to treat said small-particle-diameter hydrophobic fine silica particles (A) is a disilazane.

65. The method according to claim 59, wherein said small-particle-diameter hydrophobic fine silica particles (A) have been treated with the silane in an amount of from 5 parts by weight to 25 parts by weight based on 100 parts by weight of the fine silica particles.

66. The method according to claim 59, wherein said small-particle-diameter hydrophobic fine silica particles (A) have a water-wettability of 70% or above.

67. The method according to claim 59, wherein said large-particle-diameter hydrophobic fine silica particles (B) have a BET specific surface area of from 20 $m^2/g$ to 60 $m^2/g$.

68. The method according to claim 59, wherein said large-particle-diameter hydrophobic fine silica particles (B) have a quantity of triboelectricity of from −60 mC/kg to −100 mC/kg.

69. The method according to claim 59, wherein the silicone oil used to treat said large-particle-diameter hydrophobic fine silica particles (B) is a treating agent selected from the group consisting of dimethylsilicone oil, methylphenylsilicone oil and methylhydrogensilicone oil.

70. The method according to claim 59, wherein the silicone oil used to treat said large-particle-diameter hydrophobic fine silica particles (B) has a viscosity of 100 cSt or below at 25° C.

71. The method according to claim 59, wherein said large-particle-diameter hydrophobic fine silica particles (B) have been treated with the silicone oil in an amount of from 2 parts by weight to 20 parts by weight based on 100 parts by weight of the fine silica particles.

72. The method according to claim 59, wherein said large-particle-diameter hydrophobic fine silica particles (B) have a water-wettability of 80% or above.

73. The method according to claim 59, wherein said fine alumina particles (C) have a quantity of triboelectricity of from +30 mC/kg to −20 mC/kg.

74. The method according to claim 59, wherein said fine alumina particles (C) have a water-wettability of 30% or below.

75. The method according to claim 59, wherein said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles, and said fine alumina particles (C) are added to the toner in an amount (c) of from 0.01 part by weight to 2.0 parts by weight based on 100 parts by weight of the toner particles.

76. The method according to claim 75, wherein said small-particle-diameter hydrophobic fine silica particles (A), large-particle-diameter hydrophobic fine silica particles (B) and fine alumina particles (C) are added in amount (a), amount (b) and amount (c), respectively, in the ratio satisfying the following relationship:

a:b:c=1:0.10 to 0.65:0.05 to 0.50.

77. The method according to claim 59, wherein said fine alumina particles (C) have a water-wettability more than 30%, and said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles and the fine alumina particles (C) having a water-wettability more than 30% are added to the toner in an amount (c1) of from 0.05 part by weight to 2.0 parts by weight based on 100 parts by weight of the toner particles.

78. The method according to claim 77, wherein said small-particle-diameter hydrophobic fine silica particles (A), large-particle-diameter hydrophobic fine silica particles (B) and fine alumina particles (C) having a water-wettability more than 30% are added in amount (a), amount (b) and amount (c1), respectively, in the ratio satisfying the following relationship:

a:b:c1=1:0.10 to 0.65:0.20 to 0.50.

79. The method according to claim 59, wherein said fine alumina particles (C) have a water-wettability not more than 30%, and said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles and the fine alumina particles (C) having a water-wettability not more than 30% are added to the toner in an amount (c2) of from 0.01 part by weight to 1.0 part by weight based on 100 parts by weight of the toner particles.

80. The method according to claim 79, wherein said small-particle-diameter hydrophobic fine silica particles (A), large-particle-diameter hydrophobic fine silica particles (B) and fine alumina particles (C) having a water-wettability not more than 30% are added in amount (a), amount (b) and amount (c2), respectively, in the ratio satisfying the following relationship:

a:b:c2=1:0.10 to 0.65:0.05 to 0.35.

81. The method according to claim 59, wherein said toner has an average circularity of from 0.950 to 1.000.

82. The method according to claim 59, wherein said toner has an average circularity of from 0.950 to 0.990.

83. The method according to claim 59, wherein said toner has an average circularity of from 0.960 to 0.985.

84. The method according to claim 59, wherein said toner particles are toner particles produced by a suspension polymerization process in which a polymerizable monomer composition is polymerized in an aqueous medium.

85. The method according to claim 59, wherein said toner particles are toner particles produced by a mechanical pulverization process having the steps of melt-kneading a toner material having a binder resin and mechanically pulverizing the resultant kneaded product.

86. The method according to claim 59, wherein said toner particles have been subjected to spherical treatment.

87. The method according to claim 59, wherein said toner is produced by mixing said toner particles, said small-particle-diameter hydrophobic fine silica particles (A), said large-particle-diameter hydrophobic fine silica particles (B) and said fine alumina particles (C) by means of a mixing machine.

88. An image forming method comprising;

an electrostatic latent image forming step of forming an electrostatic latent image on a latent image bearing member; and a developing step of developing with a toner the electrostatic latent image formed on the latent image bearing member;

wherein;

in the developing step, said toner is fed onto a developer carrying member by means of a developer feed roller brought into contact with the developer carrying member, the layer thickness of said toner is regulated by means of a developer layer thickness regulating member brought into touch with the surface of the developer carrying member, and the electrostatic latent image is developed with the toner of a layer-thickness-regulated toner layer, carried on the developer carrying member; and said toner has toner particles and an external additive;

said toner particles having a weight-average particle diameter of from 4 $\mu$m to 9 $\mu$m; and said external additive having (i) first, small-particle-diameter hydrophobic fine silica particles (A) having a primary particle 50% particle diameter of from 5 nm to 20 nm, having been treated with a silane, (ii) second, large-particle-diameter hydrophobic fine silica particles (B) having a primary particle 50% particle diameter of from 30 nm to 150 nm, having been treated with a silicone oil, and (iii) fine alumina particles (C) having a BET specific surface area of from 50 $m^2/g$ to 150 $m^2/g$.

89. The method according to claim 88, wherein said small-particle-diameter hydrophobic fine silica particles (A) have a BET specific surface area of from 100 $m^2/g$ to 350 $m^2/g$, and said large-particle-diameter hydrophobic fine silica particles (B) have a BET specific surface area of from 15 $m^2/g$ to 80 $m^2/g$.

90. The method according to claim 88, wherein said small-particle-diameter hydrophobic fine silica particles (A) have a BET specific surface area of from 150 $m^2/g$ to 300 $m^2/g$.

91. The method according to claim 88, wherein said small-particle-diameter hydrophobic fine silica particles (A) have a quantity of triboelectricity of from −40 mC/kg to −150 mC/kg.

92. The method according to claim 88, wherein the silane used to treat said small-particle-diameter hydrophobic fine silica particles (A) is a treating agent selected from the group consisting of an alkoxysilane, a silazane and a chlorosilane.

93. The method according to claim 88, wherein the silane used to treat said small-particle-diameter hydrophobic fine silica particles (A) is a disilazane.

94. The method according to claim 88, wherein said small-particle-diameter hydrophobic fine silica particles (A) have been treated with the silane in an amount of from 5 parts by weight to 25 parts by weight based on 100 parts by weight of the fine silica particles.

95. The method according to claim 88, wherein said small-particle-diameter hydrophobic fine silica particles (A) have a water-wettability of 70% or above.

96. The method according to claim 88, wherein said large-particle-diameter hydrophobic fine silica particles (B) have a BET specific surface area of from 20 $m^2/g$ to 60 $m^2/g$.

97. The method according to claim 88, wherein said large-particle-diameter hydrophobic fine silica particles (B) have a quantity of triboelectricity of from −60 mC/kg to −100 mC/kg.

98. The method according to claim 88, wherein the silicone oil used to treat said large-particle-diameter hydrophobic fine silica particles (B) is a treating agent selected from the group consisting of dimethylsilicone oil, methylphenylsilicone oil and methylhydrogensilicone oil.

99. The method according to claim 88, wherein the silicone oil used to treat said large-particle-diameter hydrophobic fine silica particles (B) has a viscosity of 100 cSt or below at 25° C.

100. The method according to claim 88, wherein said large-particle-diameter hydrophobic fine silica particles (B) have been treated with the silicone oil in an amount of from 2 parts by weight to 20 parts by weight based on 100 parts by weight of the fine silica particles.

101. The method according to claim 88, wherein said large-particle-diameter hydrophobic fine silica particles (B) have a water-wettability of 80% or above.

102. The method according to claim 88, wherein said fine alumina particles (C) have a quantity of triboelectricity of from +30 mC/kg to −20 mC/kg.

103. The method according to claim 88, wherein said fine alumina particles (C) have a water-wettability of 30% or below.

104. The method according to claim 88, wherein said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles, and said fine alumina particles (C) are added to the toner in an amount (c) of from 0.01 part by weight to 2.0 parts by weight based on 100 parts by weight of the toner particles.

105. The method according to claim 104, wherein said small-particle-diameter hydrophobic fine silica particles (A), large-particle-diameter hydrophobic fine silica particles (B) and fine alumina particles (C) are added in amount (a), amount (b) and amount (c), respectively, in the ratio satisfying the following relationship:

a:b:c=1:0.10 to 0.65:0.05 to 0.50.

106. The method according to claim 88, wherein said fine alumina particles (C) have a water-wettability more than 30%, and said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles and the fine alumina particles (C) having a water-wettability more than 30% are added to the toner in an amount (c1) of from 0.05 part by weight to 2.0 parts by weight based on 100 parts by weight of the toner particles.

107. The method according to claim 106, wherein said small-particle-diameter hydrophobic fine silica particles (A), large-particle-diameter hydrophobic fine silica particles (B) and fine alumina particles (C) having a water-wettability more than 30% are added in amount (a), amount (b) and amount (c1), respectively, in the ratio satisfying the following relationship:

a:b:c1=1:0.10 to 0.65:0.20 to 0.50.

108. The method according to claim 88, wherein said fine alumina particles (C) have a water-wettability not more than 30%, and said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles and the fine alumina particles (C) having a water-wettability not more than 30% are added to the toner in an amount (c2) of from 0.01 part by weight to 1.0 part by weight based on 100 parts by weight of the toner particles.

109. The method according to claim 108, wherein said small-particle-diameter hydrophobic fine silica particles (A), large-particle-diameter hydrophobic fine silica particles (B) and fine alumina particles (C) having a water-wettability not more than 30% are added in amount (a), amount (b) and amount (c2), respectively, in the ratio satisfying the following relationship:

a:b:c2=1:0.10 to 0.65:0.05 to 0.35.

110. The method according to claim 88, wherein said toner has an average circularity of from 0.950 to 1.000.

111. The method according to claim 88, wherein said toner has an average circularity of from 0.950 to 0.990.

112. The method according to claim 88, wherein said toner has an average circularity of from 0.960 to 0.985.

113. The method according to claim 88, wherein said toner particles are toner particles produced by a suspension polymerization process in which a polymerizable monomer composition is polymerized in an aqueous medium.

114. The method according to claim 88, wherein said toner particles are toner particles produced by a mechanical pulverization process having the steps of melt-kneading a toner material having a binder resin and mechanically pulverizing the resultant kneaded product.

115. The method according to claim 88, wherein said toner particles have been subjected to spherical treatment.

116. The method according to claim 88, wherein said toner is produced by mixing said toner particles, said small-particle-diameter hydrophobic fine silica particles (A), said large-particle-diameter hydrophobic fine silica particles (B) and said fine alumina particles (C) by means of a mixing machine.

117. An apparatus unit detachably mountable on the main assembly of an image forming apparatus; the unit comprising;

a toner;

a developer container for holding the toner; and a developer carrying member for carrying thereon the toner held in the developer container and transporting the toner to a developing zone;

wherein;

said toner has toner particles and an external additive;

said toner particles having a weight-average particle diameter of from 4 $\mu$m to 9 $\mu$m; and said external additive having (i) first, small-particle-diameter hydrophobic fine silica particles (A) having a BET specific surface area of from 100 $m^2/g$ to 350 $m^2/g$, having been treated with a silane, (ii) second, large-particle-diameter hydrophobic fine silica particles (B) having a BET specific surface area of from 15 $m^2/g$ to 80 $m^2/g$, having been treated with a silicone oil, and (iii) fine alumina particles (C) having a BET specific surface area of from 50 $m^2/g$ to 150 $m^2/g$.

118. The apparatus unit according to claim 117, wherein said small-particle-diameter hydrophobic fine silica particles (A) have a primary particle 50% particle diameter of from 5 nm to 20 nm, and said large-particle-diameter hydrophobic fine silica particles (B) have a primary particle 50% particle diameter of from 30 nm to 150 nm.

119. The apparatus unit according to claim 117, wherein said small-particle-diameter hydrophobic fine silica particles (A) have a BET specific surface area of from 150 $m^2/g$ to 300 $m^2/g$.

120. The apparatus unit according to claim 117, wherein said small-particle-diameter hydrophobic fine silica particles (A) have a quantity of triboelectricity of from −40 mC/kg to −150 mC/kg.

121. The apparatus unit according to claim 117, wherein the silane used to treat said small-particle-diameter hydrophobic fine silica particles (A) is a treating agent selected from the group consisting of an alkoxysilane, a silazane and a chlorosilane.

122. The apparatus unit according to claim 117, wherein the silane used to treat said small-particle-diameter hydrophobic fine silica particles (A) is a disilazane.

123. The apparatus unit according to claim 117, wherein said small-particle-diameter hydrophobic fine silica particles (A) have been treated with the silane in an amount of from 5 parts by weight to 25 parts by weight based on 100 parts by weight of the fine silica particles.

124. The apparatus unit according to claim 117, wherein said small-particle-diameter hydrophobic fine silica particles (A) have a water-wettability of 70% or above.

125. The apparatus unit according to claim 117, wherein said large-particle-diameter hydrophobic fine silica particles (B) have a BET specific surface area of from 20 $m^2/g$ to 60 $m^2/g$.

126. The apparatus unit according to claim 117, wherein said large-particle-diameter hydrophobic fine silica particles (B) have a quantity of triboelectricity of from −60 mC/kg to −100 mC/kg.

127. The apparatus unit according to claim 117, wherein the silicone oil used to treat said large-particle-diameter hydrophobic fine silica particles (B) is a treating agent selected from the group consisting of dimethylsilicone oil, methylphenylsilicone oil and methylhydrogensilicone oil.

128. The apparatus unit according to claim 117, wherein the silicone oil used to treat said large-particle-diameter hydrophobic fine silica particles (B) has a viscosity of 100 cSt or below at 25° C.

129. The apparatus unit according to claim 117, wherein said large-particle-diameter hydrophobic fine silica particles (B) have been treated with the silicone oil in an amount of from 2 parts by weight to 20 parts by weight based on 100 parts by weight of the fine silica particles.

130. The apparatus unit according to claim 117, wherein said large-particle-diameter hydrophobic fine silica particles (B) have a water-wettability of 80% or above.

131. The apparatus unit according to claim 117, wherein said fine alumina particles (C) have a quantity of triboelectricity of from +30 mC/kg to −20 mC/kg.

132. The apparatus unit according to claim 117, wherein said fine alumina particles (C) have a water-wettability of 30% or below.

133. The apparatus unit according to claim 117, wherein said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles, and said fine alumina particles (C) are added to the toner in an amount (c) of from 0.01 part by weight to 2.0 parts by weight based on 100 parts by weight of the toner particles.

134. The apparatus unit according to claim 133, wherein said small-particle-diameter hydrophobic fine silica particles (A), large-particle-diameter hydrophobic fine silica particles (B) and fine alumina particles (C) are added in amount (a), amount (b) and amount (c), respectively, in the ratio satisfying the following relationship:

a:b:c=1:0.10 to 0.65:0.05 to 0.50.

135. The apparatus unit according to claim 117, wherein said fine alumina particles (C) have a water-wettability more than 30%, and said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles and the fine alumina particles (C) having a water-wettability more than 30% are added to the toner in an amount (c1) of from 0.05 part by weight to 2.0 parts by weight based on 100 parts by weight of the toner particles.

136. The apparatus unit according to claim 135, wherein said small-particle-diameter hydrophobic fine silica particles (A), large-particle-diameter hydrophobic fine silica particles (B) and fine alumina particles (C) having a water-wettability more than 30% are added in amount (a), amount (b) and amount (c1), respectively, in the ratio satisfying the following relationship:

a:b:c1=1:0.10 to 0.65:0.20 to 0.50.

137. The apparatus unit according to claim 117, wherein said fine alumina particles (C) have a water-wettability not more than 30%, and said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles and the fine alumina particles (C) having a water-wettability not more than 30% are added to the toner in an amount (c2) of from 0.01 part by weight to 1.0 part by weight based on 100 parts by weight of the toner particles.

138. The apparatus unit according to claim 137, wherein said small-particle-diameter hydrophobic fine silica particles (A), large-particle-diameter hydrophobic fine silica particles (B) and fine alumina particles (C) having a water-wettability not more than 30% are added in amount (a), amount (b) and amount (c2), respectively, in the ratio satisfying the following relationship:

a:b:c2=1:0.10 to 0.65:0.05 to 0.35.

139. The apparatus unit according to claim 117, wherein said toner has an average circularity of from 0.950 to 1.000.

140. The apparatus unit according to claim 117, wherein said toner has an average circularity of from 0.950 to 0.990.

141. The apparatus unit according to claim 117, wherein said toner has an average circularity of from 0.960 to 0.985.

142. The apparatus unit according to claim 117, wherein said toner particles are toner particles produced by a suspension polymerization process in which a polymerizable monomer composition is polymerized in an aqueous medium.

143. The apparatus unit according to claim 117, wherein said toner particles are toner particles produced by a mechanical pulverization process having the steps of melt-kneading a toner material having a binder resin and mechanically pulverizing the resultant kneaded product.

144. The apparatus unit according to claim 117, wherein said toner particles have been subjected to spherical treatment.

145. The apparatus unit according to claim 117, wherein said toner is produced by mixing said toner particles, said small-particle-diameter hydrophobic fine silica particles (A), said large-particle-diameter hydrophobic fine silica particles (B) and said fine alumina particles (C) by means of a mixing machine.

146. The apparatus unit according to claim 117, which further comprises (i) a developer feed roller brought into contact with said developer carrying member surface for feeding said toner to the surface of said developer carrying member and (ii) a developer layer thickness regulating member for regulating the layer thickness of the toner formed on said developer carrying member as an elastic blade.

147. An apparatus unit detachably mountable on the main assembly of an image forming apparatus; the unit comprising;

a toner;

a developer container for holding the toner; and a developer carrying member for carrying thereon the toner held in the developer container and transporting the toner to a developing zone;

wherein;

said toner has toner particles and an external additive;

said toner particles having a weight-average particle diameter of from 4 $\mu$m to 9 $\mu$m; and said external additive having (i) first, small-particle-diameter hydrophobic fine silica particles (A) having a primary particle 50% particle diameter of from 5 nm to 20 nm, having been treated with a silane, (ii) second, large-particle-diameter hydrophobic fine silica particles (B) having a primary particle 50% particle diameter of from 30 nm to 150 nm, having been treated with a silicone oil, and (iii) fine alumina particles (C) having a BET specific surface area of from 50 $m^2/g$ to 150 $m^2/g$.

148. The apparatus unit according to claim 147, wherein said small-particle-diameter hydrophobic fine silica particles (A) have a BET specific surface area of from 100 $m^2/g$ to 350 $m^2/g$, and said large-particle-diameter hydrophobic fine silica particles (B) have a BET specific surface area of from 15 $m^2/g$ to 80 $m^2/g$.

149. The apparatus unit according to claim 147, wherein said small-particle-diameter hydrophobic fine silica particles (A) have a BET specific surface area of from 150 $m^2/g$ to 300 $m^2/g$.

150. The apparatus unit according to claim 147, wherein said small-particle-diameter hydrophobic fine silica particles (A) have a quantity of triboelectricity of from −40 mC/kg to −150 mC/kg.

151. The apparatus unit according to claim 147, wherein the silane used to treat said small-particle-diameter hydrophobic fine silica particles (A) is a treating agent selected from the group consisting of an alkoxysilane, a silazane and a chlorosilane.

152. The apparatus unit according to claim 147, wherein the silane used to treat said small-particle-diameter hydrophobic fine silica particles (A) is a disilazane.

153. The apparatus unit according to claim 147, wherein said small-particle-diameter hydrophobic fine silica particles (A) have been treated with the silane in an amount of from 5 parts by weight to 25 parts by weight based on 100 parts by weight of the fine silica particles.

154. The apparatus unit according to claim 147, wherein said small-particle-diameter hydrophobic fine silica particles (A) have a water-wettability of 70% or above.

155. The apparatus unit according to claim 147, wherein said large-particle-diameter hydrophobic fine silica particles (B) have a BET specific surface area of from 20 $m^2/g$ to 60 $m^2/g$.

156. The apparatus unit according to claim 147, wherein said large-particle-diameter hydrophobic fine silica particles (B) have a quantity of triboelectricity of from −60 mC/kg to −100 mC/kg.

157. The apparatus unit according to claim 147, wherein the silicone oil used to treat said large-particle-diameter hydrophobic fine silica particles (B) is a treating agent selected from the group consisting of dimethylsilicone oil, methylphenylsilicone oil and methylhydrogensilicone oil.

158. The apparatus unit according to claim 147, wherein the silicone oil used to treat said large-particle-diameter hydrophobic fine silica particles (B) has a viscosity of 100 cSt or below at 25° C.

159. The apparatus unit according to claim 147, wherein said large-particle-diameter hydrophobic fine silica particles (B) have been treated with the silicone oil in an amount of from 2 parts by weight to 20 parts by weight based on 100 parts by weight of the fine silica particles.

160. The apparatus unit according to claim 147, wherein said large-particle-diameter hydrophobic fine silica particles (B) have a water-wettability of 80% or above.

161. The apparatus unit according to claim 147, wherein said fine alumina particles (C) have a quantity of triboelectricity of from +30 mC/kg to −20 mC/kg.

162. The apparatus unit according to claim 147, wherein said fine alumina particles (C) have a water-wettability of 30% or below.

163. The apparatus unit according to claim 147, wherein said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles, and said fine alumina particles (C) are added to the toner in an amount (c) of from 0.01 part by weight to 2.0 parts by weight based on 100 parts by weight of the toner particles.

164. The apparatus unit according to claim 163, wherein said small-particle-diameter hydrophobic fine silica particles (A), large-particle-diameter hydrophobic fine silica particles (B) and fine alumina particles (C) are added in amount (a), amount (b) and amount (c), respectively, in the ratio satisfying the following relationship:

a:b:c=1:0.10 to 0.65:0.05 to 0.50.

165. The apparatus unit according to claim 147, wherein said fine alumina particles (C) have a water-wettability more than 30%, and said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles and the fine alumina particles (C) having a water-wettability more than 30% are added to the toner in an amount (c1) of from 0.05 part by weight to 2.0 parts by weight based on 100 parts by weight of the toner particles.

166. The apparatus unit according to claim 165, wherein said small-particle-diameter hydrophobic fine silica particles (A), large-particle-diameter hydrophobic fine silica particles (B) and fine alumina particles (C) having a water-wettability more than 30% are added in amount (a), amount (b) and amount (c1), respectively, in the ratio satisfying the following relationship:

a:b:c1=1:0.10 to 0.65:0.20 to 0.50.

167. The apparatus unit according to claim 147, wherein said fine alumina particles (C) have a water-wettability not more than 30%, and said small-particle-diameter hydrophobic fine silica particles (A) are added to the toner in an amount (a) of from 0.3 part by weight to 2.5 parts by weight based on 100 parts by weight of the toner particles, said large-particle-diameter hydrophobic fine silica particles (B) are added to the toner in an amount (b) of from 0.05 part by weight to 1.5 parts by weight based on 100 parts by weight of the toner particles and the fine alumina particles (C) having a water-wettability not more than 30% are added to the toner in an amount (c2) of from 0.01 part by weight to 1.0 part by weight based on 100 parts by weight of the toner particles.

168. The apparatus unit according to claim 167, wherein said small-particle-diameter hydrophobic fine silica particles (A), large-particle-diameter hydrophobic fine silica particles (B) and fine alumina particles (C) having a water-wettability not more than 30% are added in amount (a), amount (b) and amount (c2), respectively, in the ratio satisfying the following relationship:

a:b:c2=1:0.10 to 0.65:0.05 to 0.35.

169. The apparatus unit according to claim 147, wherein said toner has an average circularity of from 0.950 to 1.000.

170. The apparatus unit according to claim 147, wherein said toner has an average circularity of from 0.950 to 0.990.

171. The apparatus unit according to claim 147, wherein said toner has an average circularity of from 0.960 to 0.985.

172. The apparatus unit according to claim 147, wherein said toner particles are toner particles produced by a suspension polymerization process in which a polymerizable monomer composition is polymerized in an aqueous medium.

173. The apparatus unit according to claim 147, wherein said toner particles are toner particles produced by a mechanical pulverization process having the steps of melt-kneading a toner material having a binder resin and mechanically pulverizing the resultant kneaded product.

174. The apparatus unit according to claim 147, wherein said toner particles have been subjected to spherical treatment.

175. The apparatus unit according to claim 147, wherein said toner is produced by mixing said toner particles, said small-particle-diameter hydrophobic fine silica particles (A), said large-particle-diameter hydrophobic fine silica particles (B) and said fine alumina particles (C) by means of a mixing machine.

176. The apparatus unit according to claim 147, which further comprises (i) a developer feed roller brought into contact with said developer carrying member surface for feeding said toner to the surface of said developer carrying member and (ii) a developer layer thickness regulating member for regulating the layer thickness of the toner formed on said developer carrying member as an elastic blade.

* * * * *